US006843546B2

(12) United States Patent
Nunokawa

(10) Patent No.: US 6,843,546 B2
(45) Date of Patent: Jan. 18, 2005

(54) DRAFT PRINTING WITH MULTIPLE SAME-HUE INK NOZZLES

(75) Inventor: Hirokazu Nunokawa, Nagano-ken (JP)

(73) Assignee: Seiko Epson Corporation, Tokyo (JP)

( * ) Notice: Subject to any disclaimer, the term of this patent is extended or adjusted under 35 U.S.C. 154(b) by 228 days.

(21) Appl. No.: 10/206,817

(22) Filed: Jul. 29, 2002

(65) Prior Publication Data

US 2003/0137556 A1 Jul. 24, 2003

Related U.S. Application Data

(60) Provisional application No. 60/349,343, filed on Jan. 22, 2002.

(51) Int. Cl.[7] ..... B41J 2/205

(52) U.S. Cl. ..... 347/15; 347/15; 347/41; 347/43

(58) Field of Search ..... 347/15, 41, 43, 347/16, 100

(56) References Cited

U.S. PATENT DOCUMENTS 6,170,932 B1 * 1/2001 Kanaya et al. ..... 347/41

* cited by examiner

*Primary Examiner*—Lamson Nguyen
(74) *Attorney, Agent, or Firm*—Sughrue Mion, PLLC

(57) ABSTRACT

To perform printing in a predetermined fast printing mode, the same-hue nozzle groups ejecting dark/light inks of each hue are each directed to form ink dots on mutually different main scan lines. This increases the effective number of nozzles, improving printing speed.

22 Claims, 20 Drawing Sheets

$K_D C_D M_D Y_D$ : Dark ink nozzle group $K_L C_L M_L Y_D$ : Light ink nozzle group Ordinary Recording Method (s = 1)

Scanning Parameters

Nozzle pitch: k = 3
Number of working nozzles: N=4
Number of scan repetitions: s=1
Number of effective nozzles: Neff=4

| Pass Number | 1 | 2 | 3 | 4 |
|---|---|---|---|---|
| Feed amount L [dot] | 0 | 4 | 4 | 4 |
| $\Sigma L$ | 0 | 4 | 8 | 12 |
| $F=(\Sigma L)\%k$ | 0 | 1 | 2 | 0 |

*Fig. 7A*
Overlapping Recording Method (s = 2)
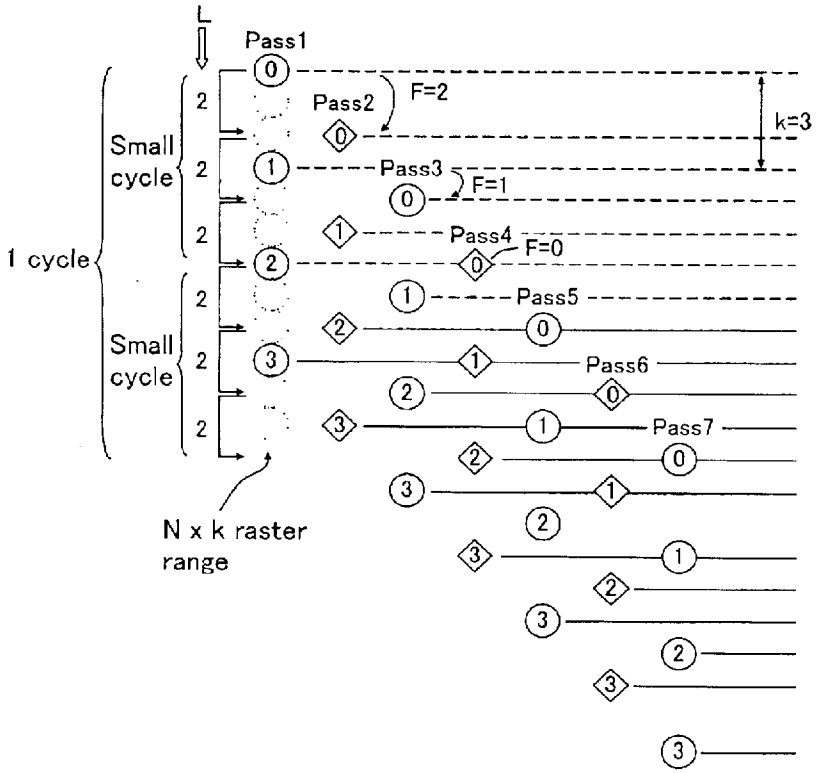
*Fig. 7B*
Scanning Parameters
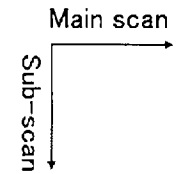
Nozzle pitch: k = 3
Number of working nozzles: N=4
Number of scan repetitions: s=2
Number of effective nozzles: Neff=2
| Pass Number | 1 | 2 | 3 | 4 | 5 | 6 | 7 |
|---|---|---|---|---|---|---|---|
| Pixels for recording | 0 | 1 | 0 | 1 | 0 | 1 | 0 |
| Feed amount L[dot] | 0 | 2 | 2 | 2 | 2 | 2 | 2 |
| ΣL | 0 | 2 | 4 | 6 | 8 | 10 | 12 |
| F=(ΣL)%k | 0 | 2 | 1 | 0 | 2 | 1 | 0 |
Pixels for recording "0": Even numbered pixel positions
Pixels for recording "1": Odd numbered pixel positions
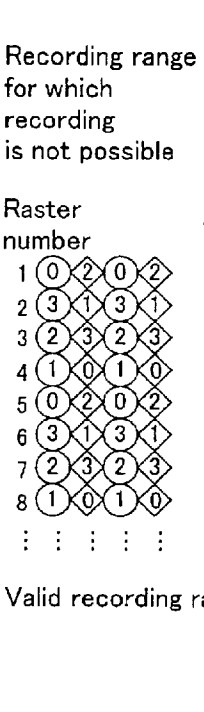

Pixels recorded by individual nozzles in normal printing and draft printing

Dn: Normal dot pitch
Dd: Draft dot pitch

*Fig.14*

Conversion of normal printing print data PD to draft printing print data PD

| Raster # | Print data | Pass | Pixel position in raster direction | 1 | 2 | 3 | 4 | 5 | 6 | 7 | 8 |
|---|---|---|---|---|---|---|---|---|---|---|---|
| #1 | Converted print data | Pass 1 | Nozzle #11 Print data | 0 | 0 | 1 | 0 | 0 | 1 | 1 | 0 |
| | (Comparison print data) | Pass 2 | Nozzle #00 Print data | 0 | 1 | 0 | 1 | 0 | 1 | 1 | 1 |
| | Converted print data | Pass 1 | Nozzle #00 Print data | 0 | 1 | 1 | 1 | 0 | 1 | 1 | 1 |
| #2 | Converted print data | Pass 1 | Nozzle #02 Print data | 1 | 0 | 0 | 1 | 0 | 0 | 0 | 1 |
| | (Comparison print data) | Pass 2 | Nozzle #10 Print data | 0 | 1 | 0 | 0 | 0 | 1 | 1 | 0 |
| | Converted print data | Pass 1 | Nozzle #10 Print data | 1 | 1 | 0 | 1 | 0 | 1 | 1 | 1 |
| #3 | Converted print data | Pass 1 | Nozzle #12 Print data | 0 | 0 | 1 | 0 | 0 | 1 | 0 | 0 |
| | (Comparison print data) | Pass 2 | Nozzle #01 Print data | 1 | 1 | 0 | 1 | 1 | 0 | 0 | 1 |
| | Converted print data | Pass 1 | Nozzle #01 Print data | 1 | 1 | 1 | 1 | 1 | 1 | 0 | 1 |

1 : Record
0 : Do not record

Second embodiment

Nozzle pitch k = 1Dd
Effective number of nozzles Neff = 9 (Total of all nozzles)
Sub-scan feed amount L = 9Dd (Band feed recording)

Third embodiment

Nozzle pitch k = 2Dd
Effective number of nozzles Neff = 6 (Total of all nozzles)
Average sub-scan feed amount ( Σ L/K) = 6Dd (12Dn)
Sub-scan feed amount L = 5Dd -7Dd (Interlace recording)

Sixth embodiment

Nozzle pitch k = 2Dd
Effective number of nozzles Neff = 9 (Combination of dark & light ink nozzles)
Sub-scan feed amount L = 9Dd (Interlace recording)

DRAFT PRINTING WITH MULTIPLE SAME-HUE INK NOZZLES

This application claims benefit of Provisional Application No. 60/349,343, filed Jan. 22, 2002; the disclosure of which is incorporated herein by reference.

BACKGROUND OF THE INVENTION

1. Field of the Invention

This invention relates to a technique for printing by means of forming ink dots on a print medium using a print head.

2. Description of the Related Art

Printing devices in which printing is performed by a print head while scanning in a main scan direction and a sub-scan direction include ink-jet printers such as serial scan printers and drum scan printers. An ink-jet printer produces text or graphics on a print medium by means of ejecting ink from a plurality of nozzles provided to the print head. The ink-jet printer provides printing modes including a print mode for high image quality printing, and a high-speed draft print mode or fast print mode.

In draft-printing for verifying graphics layout for example, high image quality is not required, but speed is of special importance. Accordingly, there exists a need for faster printing in draft printing.

SUMMARY OF THE INVENTION

Accordingly, an object of the present invention is to provide a technique for improving printing speed in draft print mode.

In order to attain the above and the other objects of the present invention, there is provided a method of printing by forming ink dots on a print medium during main scans. The method comprises the steps of: (a) providing a print head comprising a same-hue nozzle group for ejecting a plurality of same-hue inks having the substantially same hue and different in at least one of lightness and saturation where the same-hue nozzle group includes a plurality of same-ink nozzle sub-groups arranged at mutually staggered positions in sub-scan direction, each of the same-ink nozzle sub-groups ejecting a same ink; and (b) forming ink dots on mutually different main scan lines with the respective same-ink nozzle sub-groups during each main scan in a predetermined fast printing mode.

In the printing method of the present invention, the nozzle groups which eject inks having the substantially same hue and different in lightness and/or saturation form ink dots on mutually different main scan lines with each of the same-hue nozzle groups during each main scan in a predetermined fast printing mode. Therefore, the number of main scan lines printed in a single pass is increased, thereby improving printing speed. Since printing is performed with inks having the substantially same hue, there is small deterioration in image quality.

Print data PD for draft printing can be generated using a color conversion table (FIG. 1) for draft printing.

This arrangement is advantageous in that the time needed to generate print data PD can be reduced, thereby reducing printing time.

Additionally, it is preferred to convert the dot data to converted dot data by performing logical addition of the dot data corresponding to the plurality of same-hue inks at each pixel, in order to generate print data PD for draft printing.

This arrangement can be implemented without preparing the color conversion table for draft printing.

Additionally, it is also possible to convert raster line data to converted raster line data by performing logical addition of the raster line data corresponding to the plurality of same-hue inks at each pixel. This arrangement can be implemented with the modification of the firmware on the printer unit.

The plurality of same-ink nozzle sub-groups included in the same-hue nozzle group may be arrayed in a single row in the sub-scan direction. The printer head can be more compact in this arrangement.

Additionally, when an area composed of array of dots is produced with the plurality of same-hue nozzle groups during a single main scan pass, the sub-scan feed amount can be set to a sub-scan direction length of the area in the fast printing mode.

The present invention can be realized in various forms such as a method and apparatus for printing, a method and apparatus for producing print data for a printing unit, and a computer program product implementing the above scheme.

These and other objects, features, aspects, and advantages of the present invention will become more apparent from the following detailed description of the preferred embodiments with the accompanying drawings.

BRIEF DESCRIPTION OF THE DRAWINGS

FIG. 7A shows an example of sub-scan feed on the basic conditions of an overlapping interlace recording method.

FIG. 7B shows the parameters of that dot recording on the basic conditions of an overlapping interlace recording method.

FIG. 14 is a process for conversion from print data PD for normal printing to print data PD for draft printing.

DESCRIPTION OF THE PREFERRED EMBODIMENT

The preferred embodiments are described in the following sequence.

A. Apparatus Structure:
B. Basic Conditions of the Recording Method:
C. Concept of Generating Multiple Levels Using a Plurality of Inks with Different Density:
D. Concept of Print Data and Sub-scan Advance in Draft Printing:
E. Comparisons and Examples of Dot Print Format in Draft Printing:

A. Apparatus Structure

Figure 1:
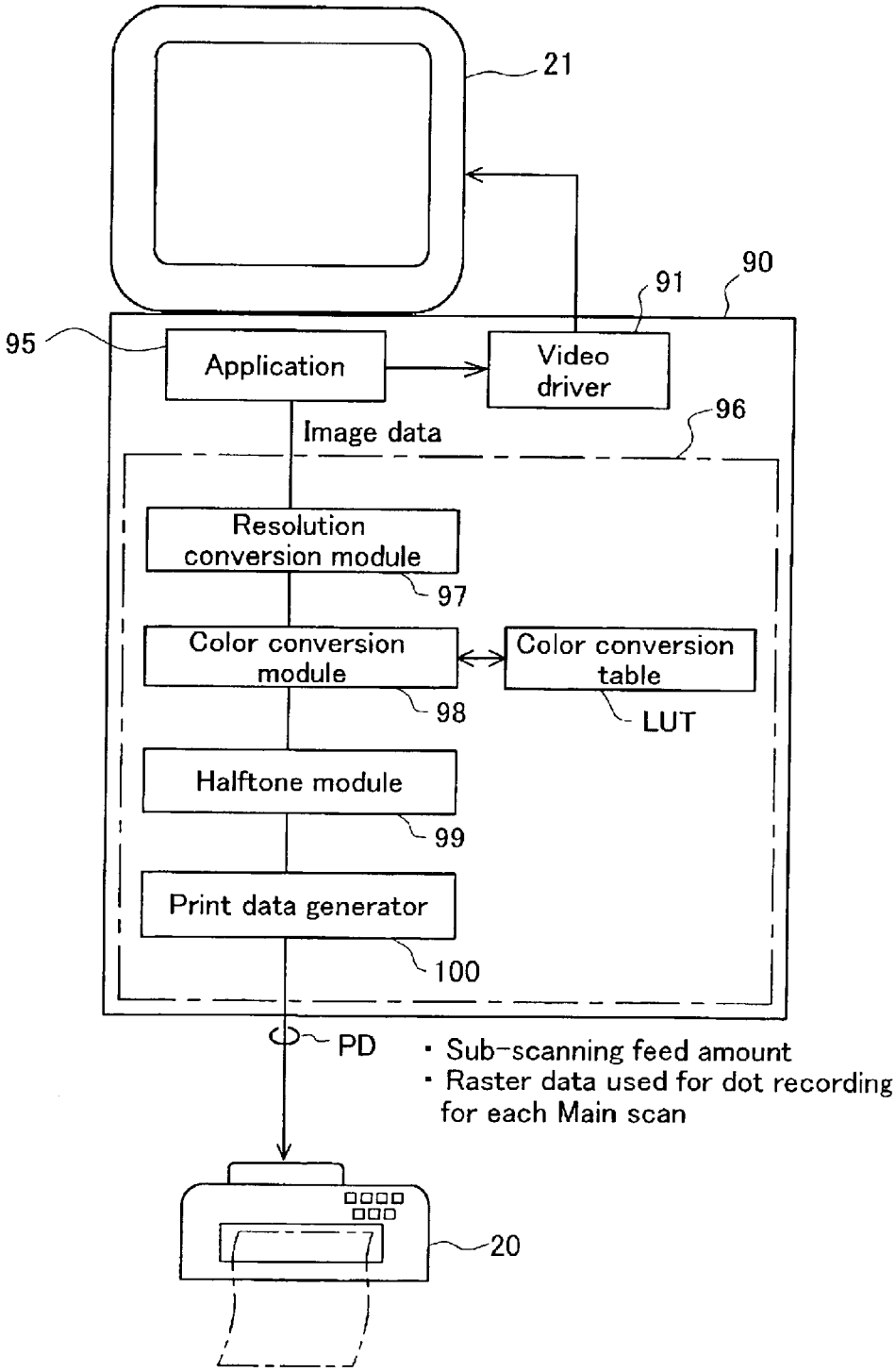
FIG. 1 is a block diagram that shows the structure of a printing system as an embodiment of the present invention.

FIG. 1 is a block diagram that shows the structure of a printing system as an embodiment of the present invention. This printing system has a computer 90 as a printing control apparatus, and a color printer 20 as a printing unit. The combination of color printer 20 and computer 90 can be called a "printing apparatus" in its broad definition.

Application program 95 operates on computer 90 under a specific operating system. Video driver 91 and printer driver 96 are incorporated in the operating system, and print data PD to be sent to color printer 20 is output via these drivers from application program 95. Application program 95 performs the desired processing on the image to be processed, and displays the image on CRT 21 with the aid of video driver 91.

When application program 95 issues a print command, printer driver 96 of computer 90 receives image data from application program 95, and converts this to print data PD to supply to color printer 20. In the embodiment shown in FIG. 1, printer driver 96 includes resolution conversion module 97, color conversion module 98, Halftone module 99, print data generator 100, and color conversion table LUT.

Resolution conversion module 97 has the role of converting the resolution (in other words, the pixel count per unit length) of the color image data handled by application program 95 to resolution that can be handled by printer driver 96. Image data that has undergone resolution conversion in this way is still image information made from the three colors RGB. Color conversion module 98 converts RGB image data to multi-tone data of multiple ink colors that can be used by color printer 20 for each pixel while referencing color conversion table LUT.

The color converted multi-tone data can have a tone value of 256 levels, for example. Halftone module 99 executes halftone processing to express this tone value on color printer 20 by distributing and forming ink dots. Image data that has undergone halftone processing is realigned in the data sequence in which it should be sent to color printer 20 by print data generator 100, and ultimately is output as print data PD. Print data PD includes raster data that shows the dot recording state during each main scan and data that shows the sub-scan feed amount.

Printer driver 96 is a program for realizing a function that generates print data PD. A program for realizing the functions of printer driver 96 is supplied in a format recorded on a recording medium that can be read by a computer. As this kind of recording medium, any variety of computer readable medium can be used, including flexible disks, CD-ROMs, opt-magnetic disks, IC cards, ROM cartridges, punch cards, printed items on which a code such a bar code is printed, a computer internal memory device (memory such as RAM or ROM), or external memory device, etc.

Figure 2:
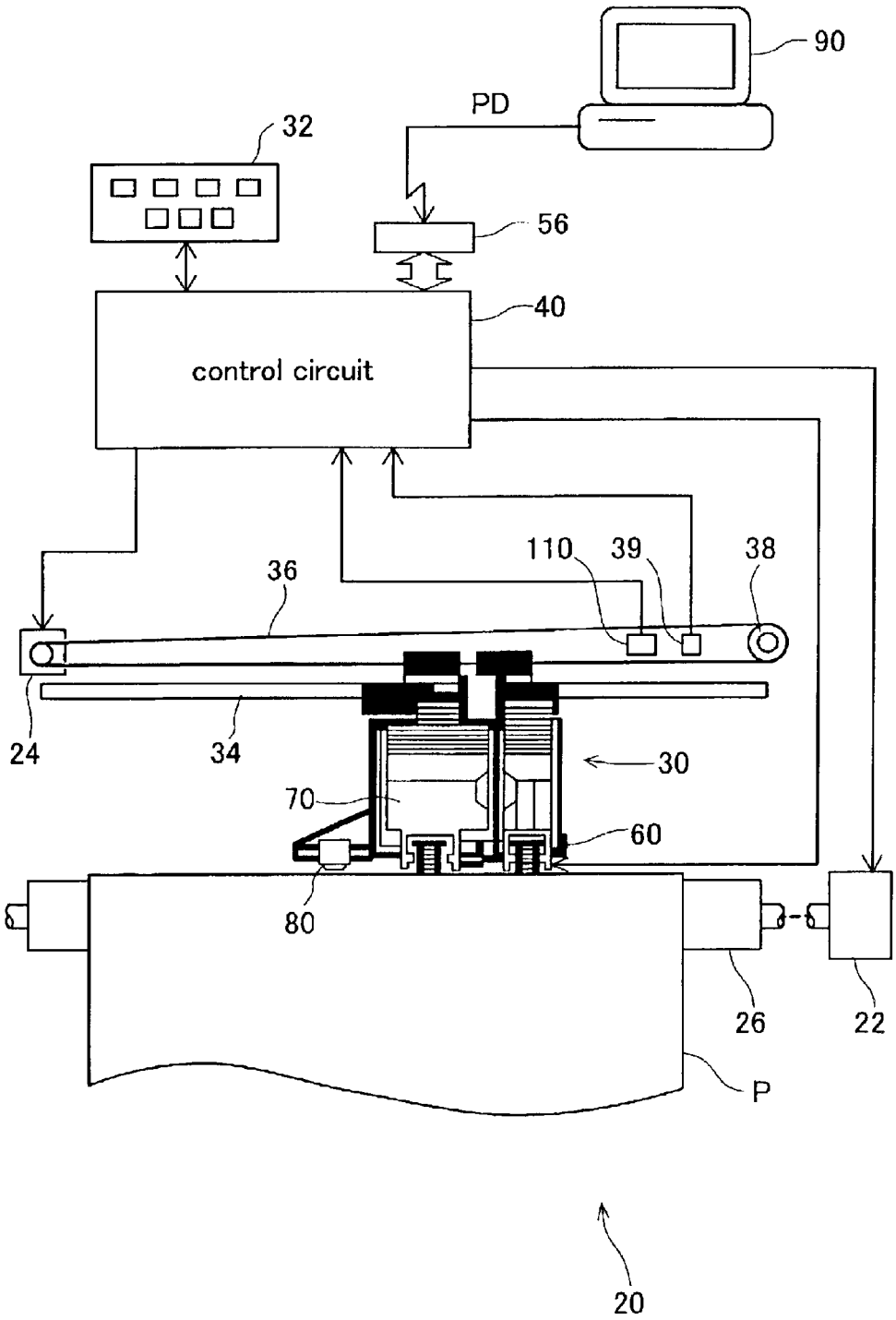
FIG. 2 is an explanatory diagram that shows the structure of the printer.

FIG. 2 is an explanatory diagram that shows the structure of the printer. Color printer 20 is equipped with a sub-scan feed mechanism, a main scan feed mechanism, a head driving mechanism, and a control circuit 40. The sub-scan feed mechanism carries printing paper P in the sub-scan direction using paper feed motor 22. The main scan feed mechanism sends cartridge 30 back and forth in the axial direction of platen 26 using carriage motor 24. The head driving mechanism drives printing head unit 60 built into carriage 30 and controls ink ejection and dot formation. The control circuit 40 controls the interaction between the signals of paper feed motor 22, carriage motor 24, printing head unit 60, and operating panel 32. Control circuit 40 is connected to computer 90 via connector 56.

The sub-scan feed mechanism is equipped with a gear train (not illustrated) that transmits the rotation of paper feed motor 22 to paper carriage roller (not illustrated). Also, the main scan feed mechanism is equipped with sliding axis 34, pulley 38, and position sensor 39. The sliding axis 34 is constructed in parallel with the axis of platen 26 and supports such that carriage 30 can slide on the axis. The pulley 38 stretches seamless drive belt 36 between the pulley and carriage motor 24. The position sensor 39 detects the starting position of carriage 30.

Figure 3:
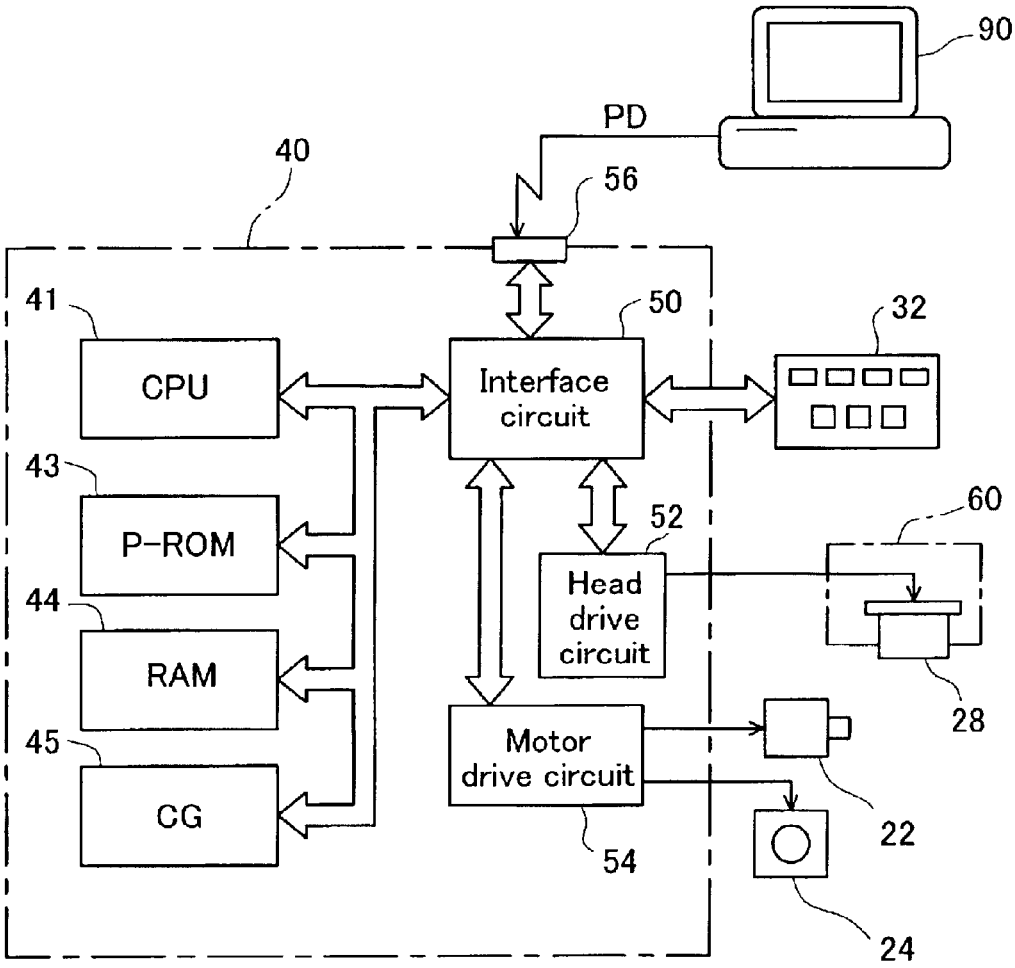
FIG. 3 is a block diagram that shows the structure of control circuit 40 in color printer 20.

FIG. 3 is a block diagram that shows the structure of control circuit 40 in color printer 20. Control circuit 40 is formed as an arithmetic and logic operating circuit that is equipped with CPU 41, programmable ROM (PROM) 43, RAM 44, and character generator (CG) 45 that stores the dot matrix of the characters. This control circuit 40 is further equipped with interface circuit 50, head drive circuit 52, motor drive circuit 54, and scanner control circuit 55. Interface circuit 50 works exclusively as an interface with external motors, etc. Head drive circuit 52 connected to this interface circuit 50 drives printing head unit 60 and ejects ink. Motor drive circuit 54 drives paper feed motor 22 and carriage motor 24. Scanner control circuit 55 controls scanner 80. Interface circuit 50 has a built-in parallel interface circuit, and can receive print data PD supplied from computer 90 via connector 56. Color printer 20 executes printing according to this print data PD. RAM 44 functions as buffer memory for temporarily storing raster data.

Printing head unit 60 has printing head 28, and holds an ink cartridge. Printing head unit 60 can be attached and detached from color printer 20 as a part. In other words, printing head 28 is replaced together with printing head unit 60.

Figure 4:
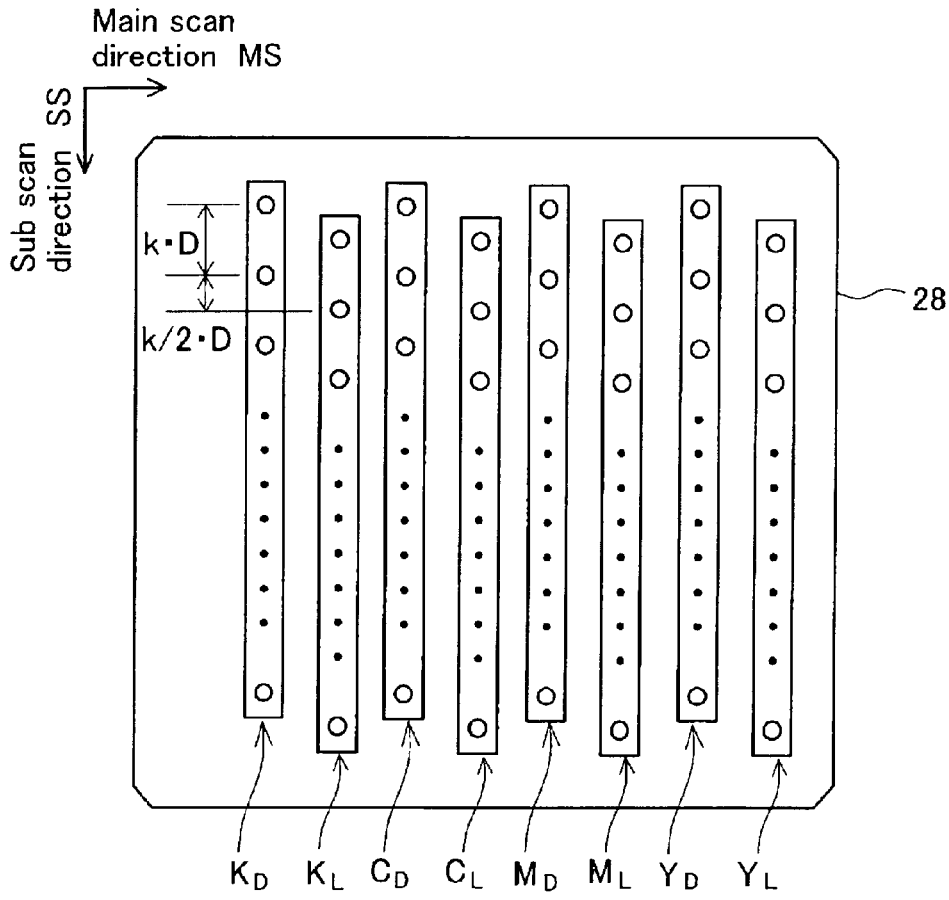
FIG. 4 is an explanatory diagram of the nozzle array on the bottom surface of printing head 28.

FIG. 4 is an explanatory diagram of the nozzle array on the bottom surface of printing head 28. Formed on the bottom surface of printing head 28 are black ink nozzle group $K_D$ for ejecting black ink, dark cyan ink nozzle group $C_D$ for ejecting dark cyan ink, light cyan ink nozzle group $C_L$ for ejecting light cyan ink, dark magenta ink nozzle group $M_D$ for ejecting dark magenta ink, light magenta ink nozzle group $M_L$ for ejecting light magenta ink, and yellow ink nozzle group $Y_D$ for ejecting yellow ink.

The upper case alphabet letters at the beginning of the reference symbols indicating each nozzle group means the ink color, and the subscript "D" means that the ink has a relatively high density and the subscript "L" means that the ink has a relatively low density. Therefore, the light ink and the dark ink of cyan, magenta, yellow, and black have same hue and different in lightness and saturation, respectively.

The multiple nozzles of each nozzle group are each aligned at a fixed nozzle pitch k•D along sub-scan direction SS. Here, k is an integer, and D is the pitch (called "dot pitch") that correlates to the printing resolution in the sub-scan direction. In this specification, we also say "the nozzle pitch is k dots." The "dot" unit means the dot pitch of print resolution. Similarly, the "dot" unit is used for sub-scan feed amount as well.

Each nozzle is provided with a piezoelectric element (not illustrated) as a drive component that drives each nozzle to eject ink drops. Ink drops are ejected from each nozzle while printing head 28 is moving in main scan direction MS.

Multiple nozzles of each nozzle group do not have to be arrayed in a straight line along the sub-scan direction, and they can be arrayed in a zigzag, for example. Even when the nozzles are arrayed in a zigzag, the nozzle pitch k•D measured in the sub-scan direction can be defined in the same way as the case shown in FIG. 4. In this specification, the phrase "multiple nozzles arrayed in the sub-scan direction" has a broad meaning that includes nozzles arrayed in a zigzag.

Figure 5:
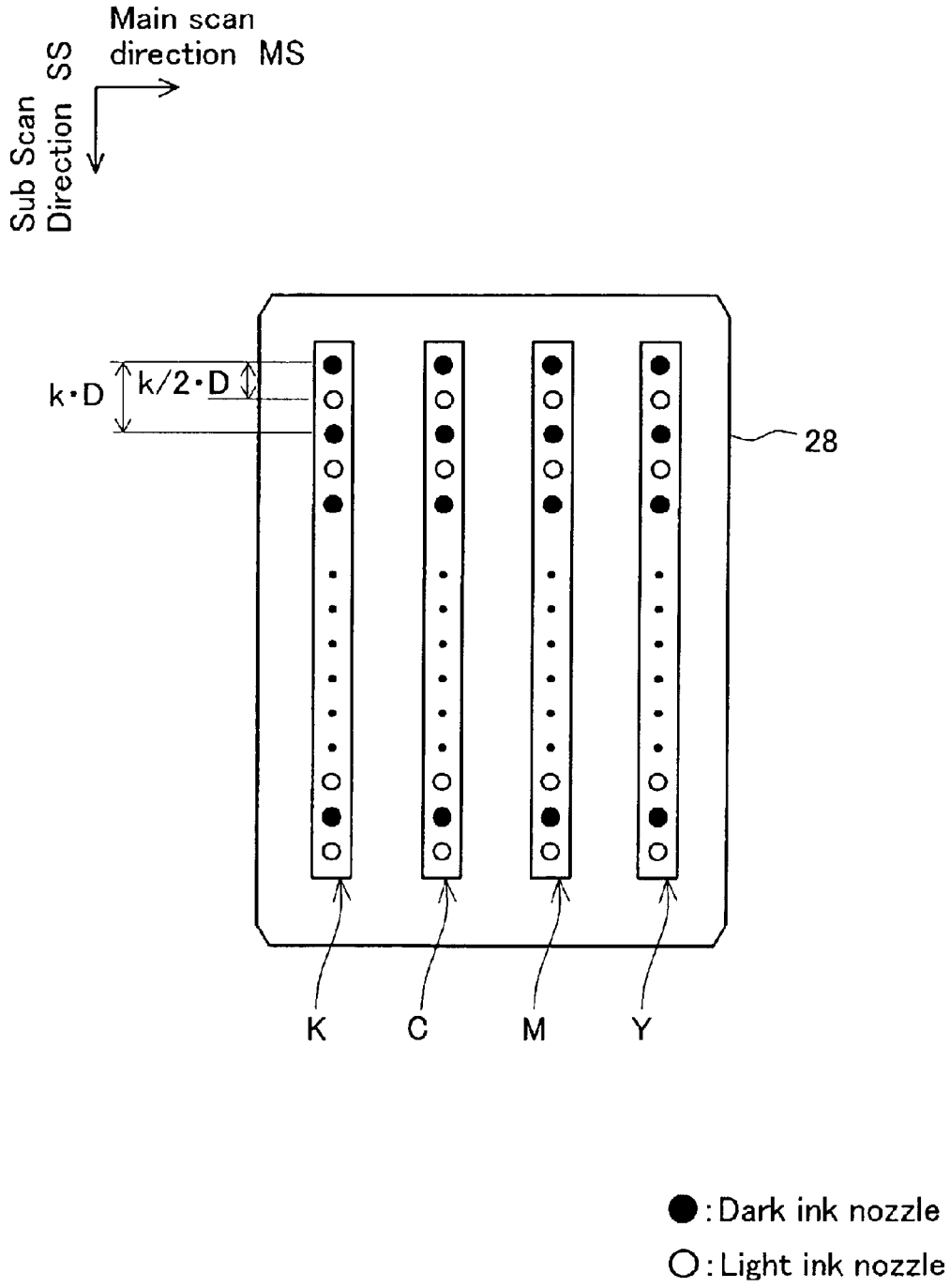
FIG. 5 is an illustrative diagram showing another exemplary nozzle arrangement on the bottom face of print head 28.

FIG. 5 is an illustrative diagram showing another exemplary nozzle arrangement on the bottom face of print head 28. The difference with the nozzle arrangement shown in FIG. 4 is that the dark ink nozzle group and light ink nozzle group are not offset in the main scan direction. That is, these nozzle groups are arrayed on the print head in a single row in the sub-scan direction. As regards the sub-scan direction, the nozzle arrangement is the same as the nozzle arrangement in FIG. 4. Arranging the dark ink nozzle group and light ink nozzle group in a single row in the sub-scan direction allows the print head 28 to be made smaller.

Color printer 20 that has the hardware configuration described above, while carrying paper P using paper feed motor 22, sends carriage 30 back and forth using carriage motor 24, and at the same time drives the piezoelectric element of printing head 28 to eject ink drops of each color to form ink drops, thereby forming a multi-tone image on paper P.

B. Basic Conditions of the Recording Method

Before giving a detailed explanation of the recording method used in the embodiments of the present invention, first, the basic conditions of a normal interlace recording method is explained hereafter. An "interlace recording method" means a recording method that is used when the nozzle pitch k in the sub-scan direction is two or greater. With an interlace recording method, with one main scan, a raster line that cannot be recorded is left between adjacent nozzles, and the pixels on this raster line are recorded during another main scan. In this specification, "printing method" and "recording method" are synonyms.

Figures 6A, 6B:
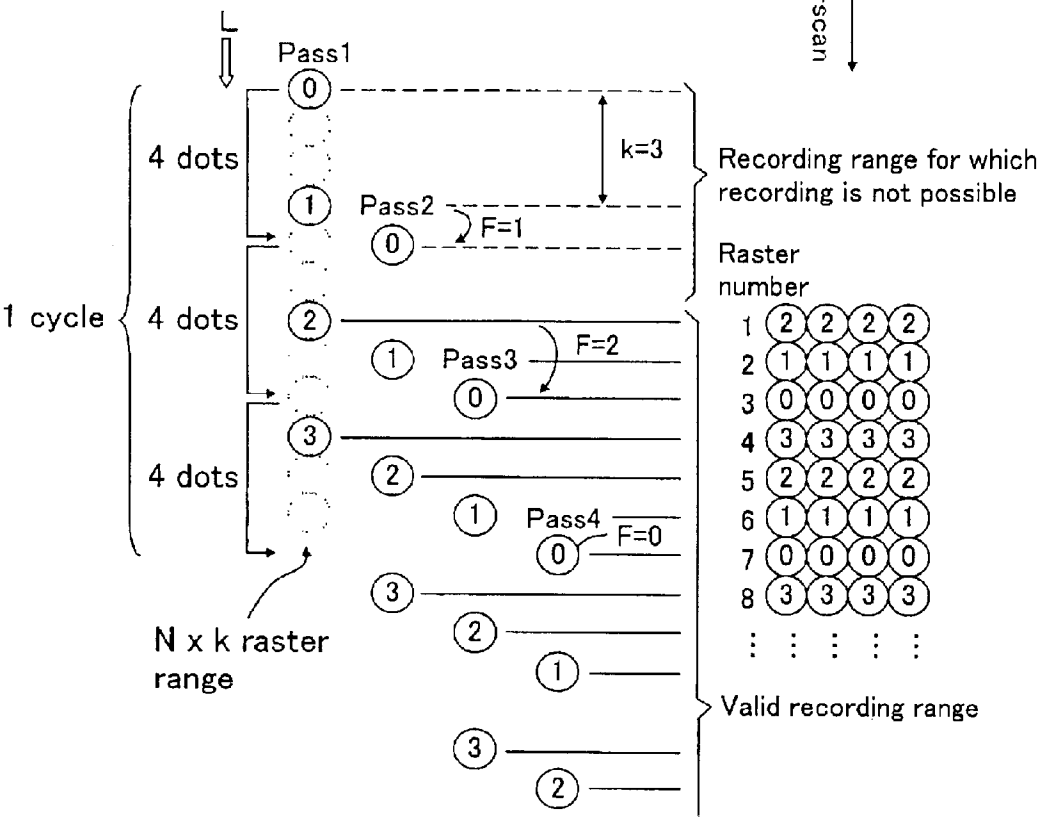
FIG. 6A shows an example of sub-scan feed on the basic conditions of a normal interlace recording method.
FIG. 6B shows the parameters of that dot recording on the basic conditions of a normal interlace recording method.

FIG. 6A shows an example of sub-scan feed on the basic conditions of a normal interlace recording method, and FIG. 6B shows the parameters of that dot recording on the basic conditions. In FIG. 6A, the solid line circle around the numbers indicates positions of the four nozzles in the sub-scan direction for each pass. The term "pass" means one main scan. The numbers 0 through 3 in the circles indicate the nozzle numbers. The positions of the four nozzles shift in the sub-scan direction each time one main scan ends. However, in reality, the sub-scan direction feed is realized by movement of the paper by paper feed motor 22 (FIG. 2).

As shown at the left side of FIG. 6A, sub-scan feed amount L is a fixed value of four dots in this example. Therefore, each time a sub-scan feed is done, the position of the four nozzles shifts by four dots each in the sub-scan direction. Each nozzle has as a recording target all dot positions (also called "pixel positions") on each raster line during one main scan. In this specification, the total number of main scans performed on each raster line (also called "main scan lines") is called "scan repetition count s."

At the right side of FIG. 6A is shown the ordinal number of the nozzle that records dots on each raster line. With the raster lines drawn by a dotted line extending in the right direction (main scan direction) from the circles that indicate the sub-scan direction position of the nozzles, at least one of the raster lines above or below this cannot be recorded, so in fact, dot recording is prohibited. Meanwhile, the raster lines drawn by a solid line extending in the main scan direction are in a range for which dots can be recorded on the raster lines before and after them. The range for which recording can actually be done will hereafter be called the valid recording range (or "valid printing range," "printing execution area," or "recording execution area").

In FIG. 6B, various parameters relating to this dot recording method are shown. Dot recording method parameters include nozzle pitch k (dots), the number of working nozzles N, the scan repetition count s, the effective nozzle count Neff, and sub-scan feed amount L (dots).

In the example in FIGS. 6A and 6B, nozzle pitch k is 3 dots. Number of working nozzles N is 4. Also, number of working nozzles N is the number of nozzles actually used among the multiple nozzles that are installed. Scan repetition count s means that main scans are executed s times on each raster line. For example, when scan repetition count s is two, main scans are executed twice on each raster line. At this time, normally dots are formed intermittently at every other dot position on one main scan. In the case shown in FIGS. 6A and 6B, the scan repetition count s is one. The effective nozzle count Neff is a value of working nozzle number N divided by scan repetition count s. This effective nozzle count Neff can be thought of as showing the net number of the raster lines for which dot recording is completed with one main scan.

In the table in FIG. 6B, the sub-scan feed amount L, its sum value ΣL, and nozzle offset F are shown for each pass. Here, offset F indicates how many dots the nozzle position is separated in the sub-scan direction from the reference positions for each pass; the reference positions for which the offset is zero are cyclical positions of the nozzles (in FIGS. 6A and 6B, a position every three dots) at the first pass. For example, as shown in FIG. 6A, after pass 1, the nozzle position moves in the sub-scan direction by sub-scan feed amount L (4 dots). Meanwhile, nozzle pitch k is 3 dots. Therefore, the nozzle offset F for pass 2 is 1 (see FIG. 6A). Similarly, the nozzle position for pass 3 is moved from the initial position by ΣL=8 dots, and the offset F is 2. The nozzle position for pass 4 moves ΣL=12 dots from the initial position, and the offset F is 0. With pass 4 after three sub-scan feeds, nozzle offset F returns to 0, and by repeating a cycle of three sub-scans, it is possible to record dots on all raster lines in the valid recording range.

As can be understood from the example in FIGS. 6A and 6B when the nozzle position is in a position separated by an integral multiple of nozzle pitch k from the initial position, offset F is 0. In addition, offset F can be given by remainder (ΣL) % k, which is obtained by dividing cumulative value ΣL of sub-scan feed amount L by nozzle pitch k. Here, "%" is an operator that indicates that the division remainder is taken. If we think of the nozzle initial position as a cyclical position, we can also think of offset F as showing the phase shift amount from the initial position of the nozzle.

When the scan repetition count s is 1, to have no gaps or overlap in the raster line that is to be recorded in the valid recording range, the following conditions must be met.

Condition c1: The number of sub-scan feeds of one cycle is equal to nozzle pitch k.

Condition c2: Nozzle offset F after each sub-scan feed in one cycle assumes a different value in a range from 0 to (k−1).

Condition c3: The average sub-scan feed amount (ΣL/k) is equal to the working nozzle number N. In other words, the cumulative value ΣL of sub-scan feed amount L per cycle is equal to the working nozzle number N multiplied by nozzle pitch k, (N×k).

Each of the aforementioned conditions can be understood by thinking as follows. There are (k−1) raster lines between adjacent nozzles. In order for a nozzle to return to the reference position (position where offset F is 0) while performing recording on these (k−1) raster lines during one cycle, the number of sub-scan feeds in one cycle will be k. If the number of sub-scan feeds in one cycle is less than k, there will be gaps in the recorded raster lines, and if there are more than k sub-scan feeds in one cycle, there will be overlap in the recorded raster lines. Therefore, the aforementioned first condition c1 is established.

When the number of sub-scan feeds in one cycle is k, gaps and overlaps in the recorded raster lines are eliminated only when the values of offset F after each sub-scan feed are different from each other in the range 0 to (k−1). Therefore, the aforementioned second condition c2 is established.

If the aforementioned first and second conditions are established, during one cycle, recording of k raster lines will be performed for each of N nozzles. Therefore, with one cycle, recording of N×k raster lines is performed. Meanwhile, if the aforementioned third condition c3 is met, as shown in FIG. 6A, the nozzle position after one cycle (after k sub-scan feeds) comes to a position separated by N×k raster lines from the initial nozzle position. Therefore, by fulfilling the aforementioned first through third conditions c1 to c3, it is possible to eliminate gaps and overlaps in the range of these N×k raster lines.

FIGS. 7A and 7B show the basic conditions of a dot recording method when the scan repetition count s is two. Hereafter, we will call a dot recording method for which the scan repetition count s is 2 or greater an "overlapping method". FIG. 7A shows an example of sub-scan feed of the overlapping interlace recording method, and FIG. 7B shows its parameters. When the scan repetition count s is 2 or greater, main scanning is executed s times on the same raster line.

The dot recording method shown in FIGS. 7A and 7B has a different scan repetition count s and sub-scan feed amount L for the parameters of the dot recording method shown in FIG. 7B. As can be seen from FIG. 7A, the sub-scan feed amount L of the dot recording method in FIGS. 7A and 7B is a fixed value of 2 dots. In FIG. 7A, the positions of nozzles at even numbered passes are shown by a diamond shape. Normally, as shown at the right side of FIG. 7A, the recorded dot positions on even numbered passes are shifted by one dot in the main scan direction from those on the odd numbered passes. Therefore, multiple dots on the same raster line are intermittently recorded by two different nozzles. For example, the topmost raster line within the valid recording range is intermittently recorded every other dot by the #0 nozzle on pass 5 after intermittent recording is done every other dot by the #2 nozzle on pass 2. With this overlapping method, each nozzle is driven with intermittent timing so that (s−1) dot recording is prohibited after 1 dot is recorded during one main scan.

In this way, the overlapping method that has intermittent pixel positions on a raster line as a recording target during each main scan is called an "intermittent overlapping method". Also, instead of having intermittent pixel positions as the recording target, it is also possible to have all pixel positions on a raster line during each main scan be the recording target. In other words, when executing a main scan s times on one raster line, it is allowable to overstrike dots on the same pixel position. This kind of overlapping method is called an "overstrike overlapping method" or "complete overlapping method".

With an intermittent overlapping method, it is acceptable, as far as the target pixel positions of the multiple nozzles on the same raster line are shifted in relation to each other, so for the actual shift amount in the main scan direction during each main scan, a variety of shift amounts other than that shown in FIG. 7A are possible. For example, it is also possible to record dots in the positions shown by circles without shifting in the main scan direction on pass 2, and to record the dots in the positions shown by diamonds with the shift in the main scan direction performed on pass 5.

The value of offset F of each pass in one cycle is shown at the bottom of the table in FIG. 7B. One cycle includes six passes, and offset F for pass 2 to pass 7 includes a value in the range of zero to two twice each. Also, the change in offset F for three passes from pass 2 to pass 4 is equal to the change in offset F for three passes from pass 5 to pass 7. As shown at the left side of FIG. 7A, the six passes of one cycle can be segmented into two small cycles of three passes each. At this time, one cycle ends by repeating a small cycle s times.

Generally, when scan repetition count s is an integer of two or greater, the first through third conditions c1 through c3 described above can be rewritten as the following conditions c1' through c3'.

Condition c1': The sub-scan feed count of one cycle is equal to the multiplied value of nozzle pitch k and scan repetition count s, (k×s).

Condition c2': Nozzle offset F after each of the sub-scan feeds in one cycle assumes a value in the range of 0 through (k−1), and each value is repeated s times.

Condition c3': The sub-scan average feed amount {ΣL/(k×s)} is equal to effective nozzle count Neff (=N/s). In other words, cumulative value ΣL of sub-scan feed amount L per cycle is equal to the multiplied value of effective nozzle count Neff and the sub-scan feed count (k×s), {Neff×(k×s)}.

The aforementioned conditions c1' through c3' also holds when scan repetition count s is one. Therefore, conditions c1' to c3' can be thought of as conditions that are generally established in interlace recording methods regardless of the value of scan repetition count s. In other words, if the aforementioned three conditions c1' through c3' are satisfied, it is possible to eliminate gaps and unnecessary overlaps for recorded dots in the valid recording range. However, when using the intermittent overlapping method, a condition is required whereby the recording positions of nozzles that record on the same raster line are shifted in relation to each other in the main scan direction. In addition, when using an overstrike overlapping method, it is enough to satisfy the aforementioned conditions c1' to c3', and for each pass, all pixel positions are subject to recording.

Figure 8:
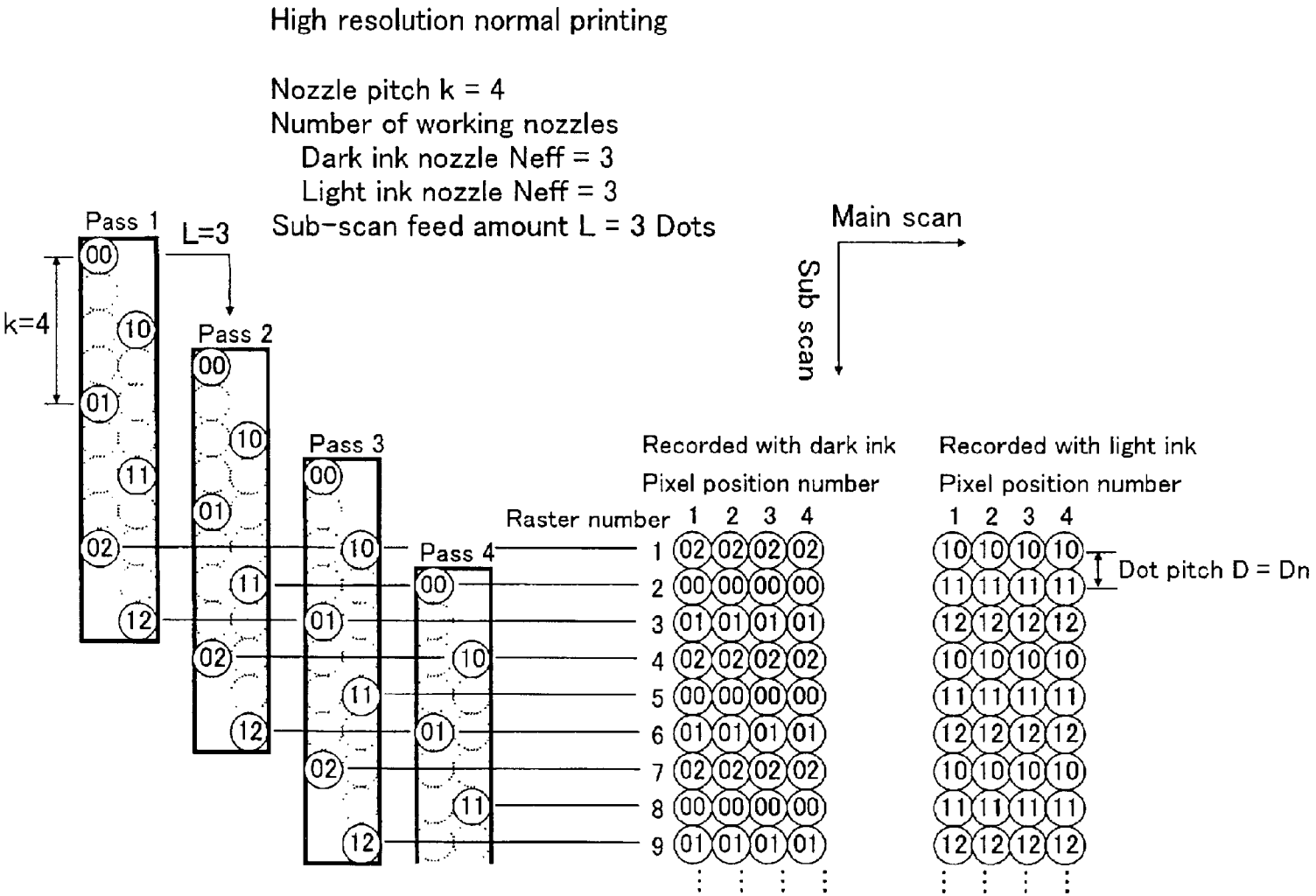
FIG. 8 is an illustrative diagram showing a dot-printing format for normal printing at high resolution.

C. Concept of Generating Multiple Levels Using a Plurality of Inks of Different Density FIG. 8 is an illustrative diagram showing a dot-printing format for normal printing at high resolution. In FIG. 8, the solid-circled numbers indicate positions in the sub-scan direction of six nozzles during each pass. The circled two-digit numbers 00–12 denote nozzle numbers. The first digit of each number designates the nozzle group, and the second digit denotes the particular nozzle of the nozzle group. Nozzles for which the first digit of the nozzle number is "0" are nozzles of the nozzle group for ejecting dark ink, and nozzles for which the first digit of the nozzle number is "1" are nozzles of the nozzle group for ejecting light ink. Here, it is assumed that the print head has three dark ink nozzles 00–02 and three light ink nozzles 10–12.

The pixel location numbers shown at the right side in FIG. 8 indicate the order of pixel arrangement on each raster line, with circled numbers indicating the number the of the nozzle assigned to produce the dot in that pixel location. For example, a first raster line composed of dots by both nozzles #02 and #10 is possible. Specifically, for the first raster line dots are produced by nozzle #01 when dark ink dots are to be produced and by nozzle #10 when light ink dots are to be produced. Even darker pixels can be produced by having the two nozzles perform overstrike recording of dots at a given pixel position. Similarly, dots on a second raster line are produced by nozzles #00 and #11, and dots on a third raster line are produced by nozzles #01 and #12. Typically, the (1+3×n)th raster line is produced by #02 and #10, the (2+3×n)th raster line by nozzles #00 and #11, and the (3+3×n)th raster line by nozzles #01 and #12. Where, n is a non-negative integer.

The print format is now described focusing on the group of nozzles that eject dark ink (00–02). As shown in FIG. 8, in this example the sub-scan feed amount L is a constant value of three dots, and the effective number of nozzles Neff of each nozzle group is 3. Other parameters for this print format are k=4 and s=1. These parameters meet the conditions c1'–c3' mentioned previously. Accordingly, for each nozzle group, printing can be performed without missing dots or unwanted overstrike of printed dots. It is therefore possible to produce dots using only a group of nozzles that eject dark ink onto pixels in all raster lines. The same is true of the group of nozzles that eject light ink (those for which the first digit of the nozzle number is "1").

As will be understood from the preceding description, the group of nozzles that eject dark ink and the group of nozzles that eject light ink can both produce dots at a same given pixel location. In this way, it is possible to produce dots using dark ink, light ink or both, to enable multi-levels. In other words, the ability to select dark ink, light ink or both to form a dot at a particular pixel location increases the tone of each pixel, improving image quality.

D. Concept of Print Data and Sub-Scan Advance in Draft Printing

Figure 9:
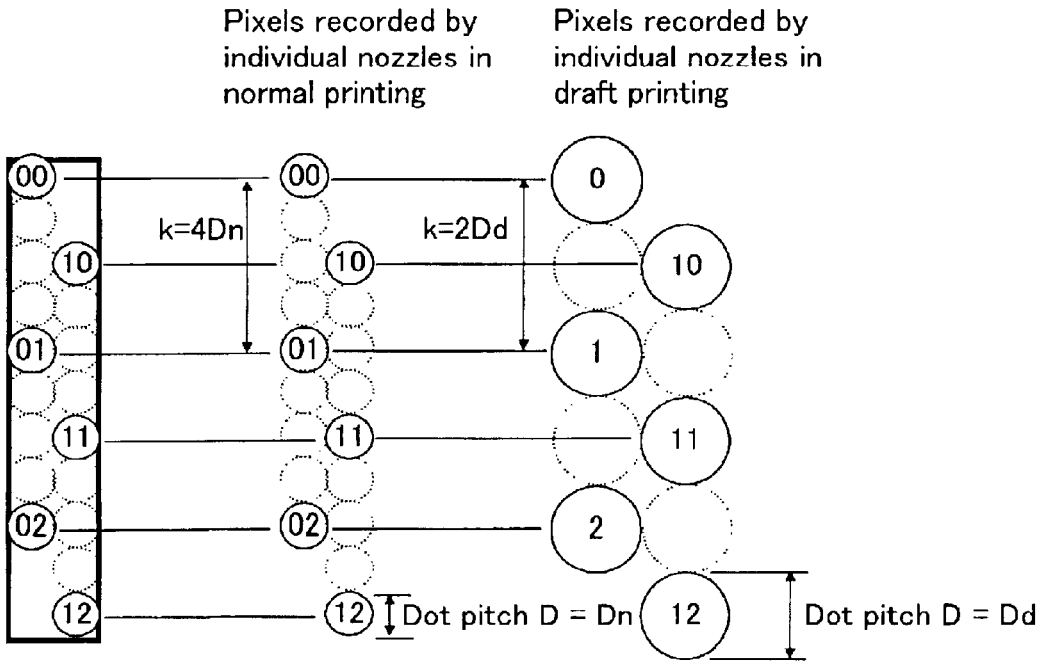
FIG. 9 is an illustrative diagram showing pixels to be printed by each nozzle in normal printing and draft printing.

FIG. 9 is an illustrative diagram showing pixels to be printed by each nozzle in normal printing and draft printing. In FIG. 9, the dot pitch Dn for normal printing corresponds to print resolution for normal printing. The dot pitch Dd for draft printing corresponds to print resolution for draft printing. These dot pitches Dd, Dn are values based on sub-scan feed amount L and nozzle pitch k in normal printing and draft printing.

In high-resolution normal printing, dot pitch Dn is relatively small, so pixels recorded by the nozzles are also small. Thus, it will be understood that for a print medium of given area, the number of pixels to be recorded increases, and more dots will have to be printed. In low-resolution draft mode, on the other hand, dot pitch Dd is relatively large, so pixels recorded by the nozzles are also large. Specifically, pixels recorded in draft printing are four times large in area than those in normal printing. Thus for a print medium of given area, a smaller number of pixels need to be recorded, so printing is possible with fewer dots (i.e. one-fourth the number). Thus, considered solely in terms of the number of dots needing to be produced, in draft printing, printing can be performed four times faster than in normal printing. Considering that the number of dots produced per unit of time is constant, printing speed is inversely proportional to the number of dots needed for printing. Four times of normal printing speed may be realized, for example, by doubling the main scanning speed and also doubling the sub-scan feed amount L.

E. Comparisons and Examples of Dot Print Format in Draft Printing

Figure 10:
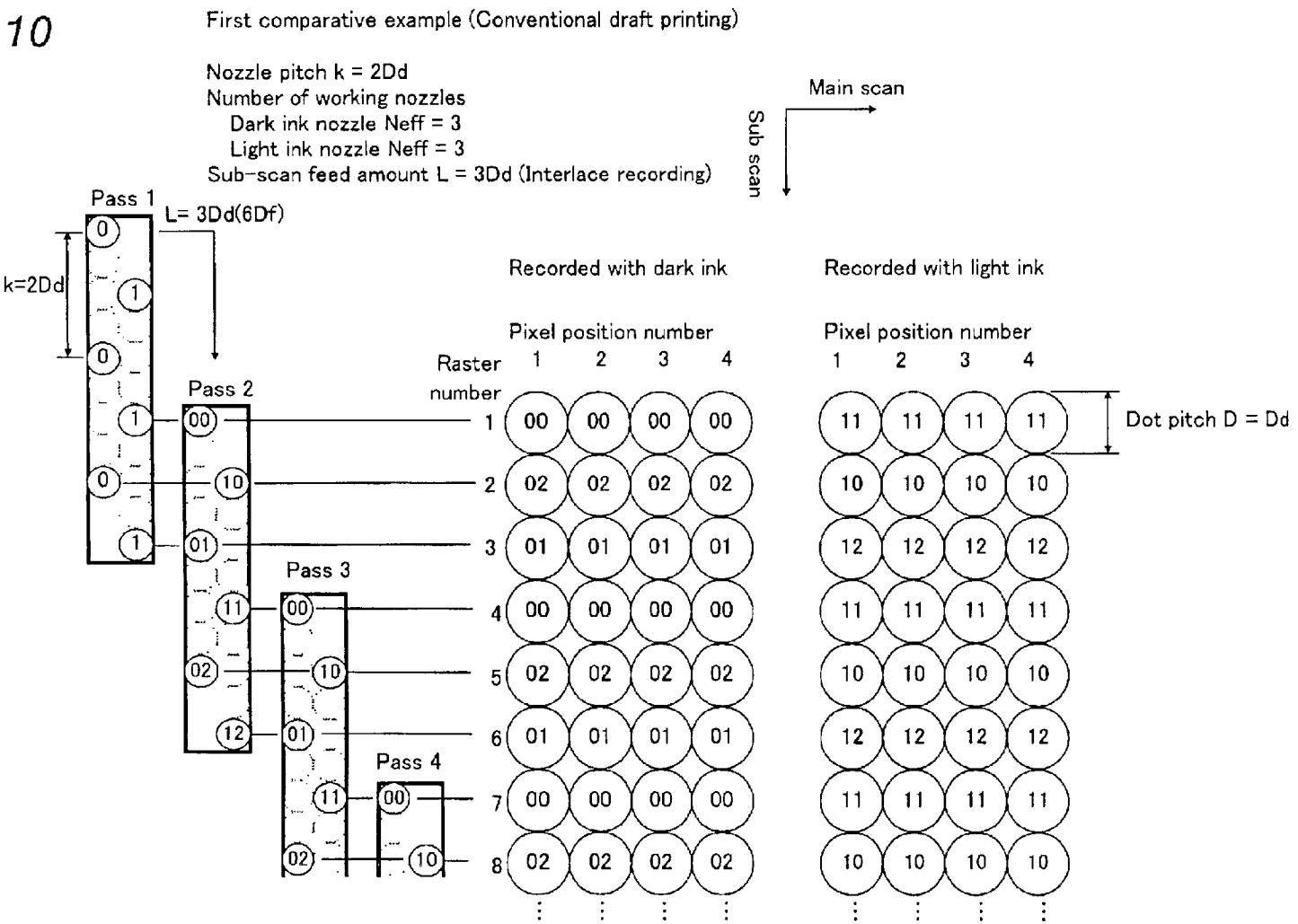
FIG. 10 is an illustrative diagram depicting first comparative example, which represents conventional draft printing.

FIG. 10 is an illustrative diagram depicting first comparative example, which represents conventional draft printing. The difference with the normal printing depicted in FIG. 8 is that the dot pitch Dd is twice the dot pitch Dn. Accordingly, main scanning speed and sub-scan advance distance L can be doubled, as described above. However, the reduced print density will result in deterioration in image quality.

The following description of the dot print format of first comparative example shall focus on printing with either one of the dark ink nozzles or light ink nozzles. Parameters for this print format are Neff=3, k=2 Ds (=4 Dn), L=3 Dd (=6 Dn) and s=1. These parameters meet conditions c1' c–3' mentioned earlier. Accordingly printing can be performed without missing dots or unwanted overstrike of printed dots.

Figure 11:
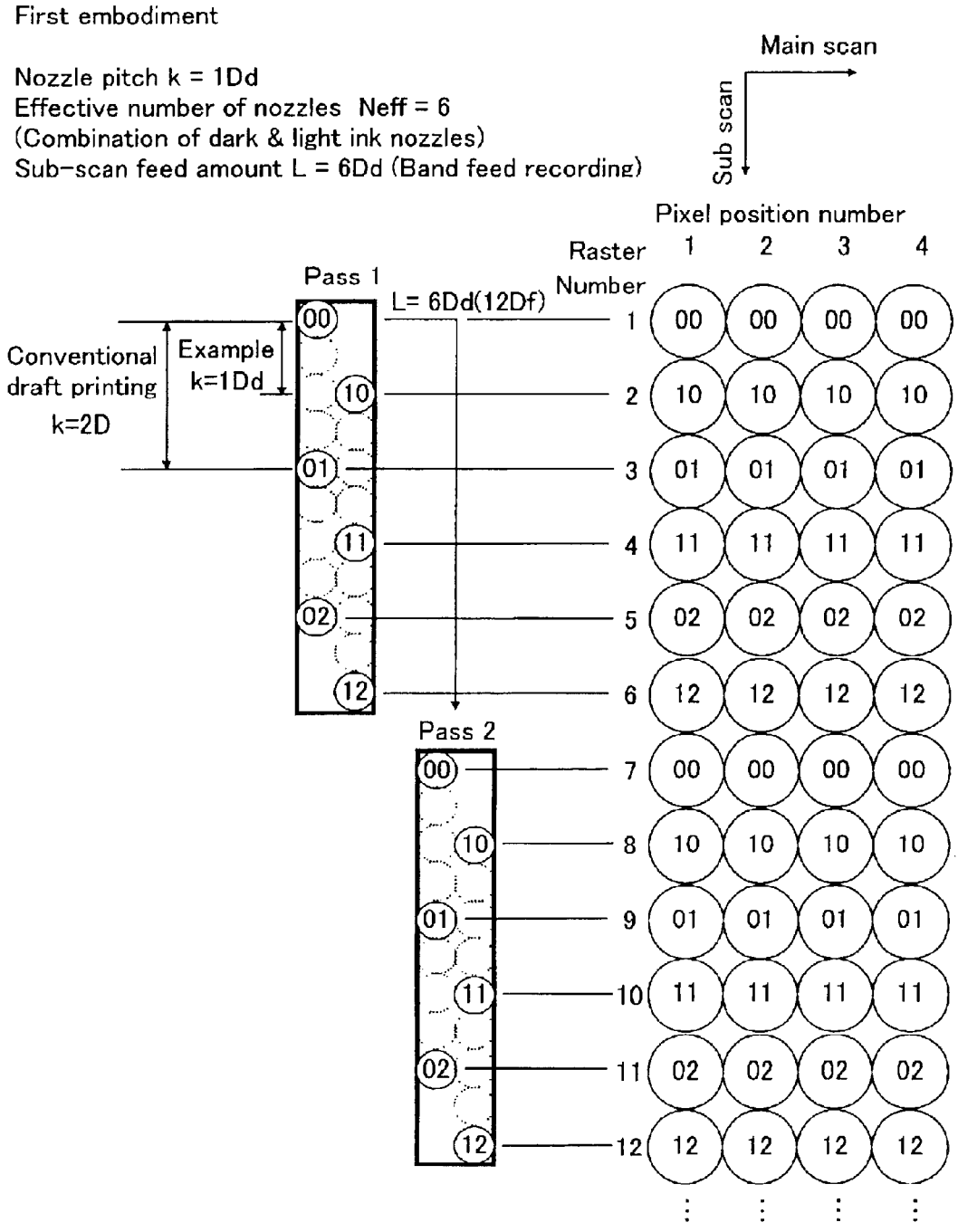
FIG. 11 is an illustrative diagram depicting the dot-printing format of the first embodiment of the invention.

FIG. 11 is an illustrative diagram depicting the dot-printing format of the first embodiment of the invention. The difference with the first comparative example depicted in FIG. 10 is that the dark ink nozzle group and light ink nozzle group produce dots on mutually different main scan lines. It is possible for the nozzle group ejecting dark ink and the nozzle group ejecting light ink to produce dots on a same given main scan line in the first comparative example depicted in FIG. 10. In the first embodiment, however, the two nozzle groups independently produce dots on mutually different main scan lines. This increases the effective number of nozzles Neff from 3 to 6 and creates an effective nozzle pitch k of 1 Dd, with raster lines formed during a single main scan (also termed a "pass") being contiguous with no gaps. As a result, there is no need to use interlaced format for sub-scan advance, thus enabling band advance to be used. Here, "band advance" refers to setting the Sub-scan feed amount L to a value equal to the length of the area composed of the array of dots that can be produced by the plurality of same-hue nozzle groups during a single main scan, as measured in the sub-scan direction.

The improvement in printing speed achieved with the first embodiment is now described in terms of the number of main scan lines printed per unit of time. The number of main scan lines printed per unit of time is the product of the number of main scans per unit of time and the effective number of nozzles Neff. In the first comparative example the dark ink nozzles and light ink nozzles are used to print the same given main scan line, so print speed is the same as with the print format in which only the dark ink nozzles are used. In the first embodiment, by contrast, all nozzles can print different numbers of main scan lines, so the pixels on each main scan line can be recorded without overstrike by all nozzle and without any break in printing. As a result, the number of main scan lines printed per unit of time in the first embodiment is double that in the first comparative example, and printing speed is accordingly double as well. The increase in printing speed is achieved by doubling the sub-scan feed amount L.

The first embodiment employs print data PD for draft printing. The reason is that the method of using the nozzles, the main scan speed, and the sub-scan feed amount L all differ from those in normal printing.

Figure 12:
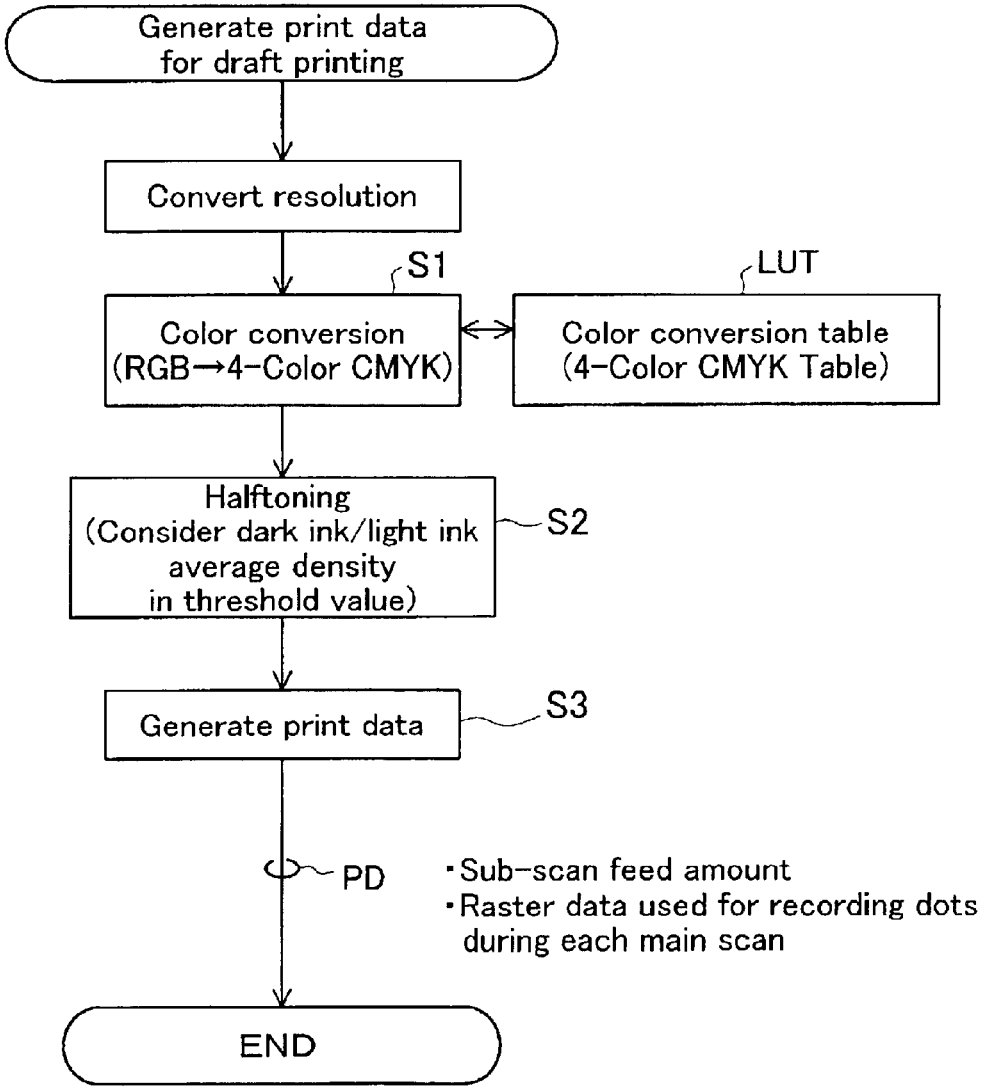
FIG. 12 is a flow chart depicting the process for generating print data PD for draft printing by the printer driver.

FIG. 12 is a flow chart depicting the process for generating print data PD for draft printing by the printer driver. This process generates print data PD for draft printing directly from RGB graphics data. Specifically, in Step S1 the printer driver 96 (FIG. 1) performs color conversion on the assumption of four colors of ink, rather than performing color conversion on the assumption of eight colors of ink as in normal printing. Color conversion is performed by color conversion module 98 (FIG. 1) making reference to a color conversion table LUT for draft printing, by converting RGB graphics data for each pixel into four-color multi-level data. In Step S2 the multi-level data resulting from color conversion is subjected to a half-tone process by half-tone module 99 (FIG. 1). The half-tone process may take into consideration the average density of inks of different densities. Specifically, by setting the threshold value used in the half-tone process on the basis of average density of the dark ink and light ink, the half-tone process may be designed to take into consideration the average density of the inks. In Step S3 the half-tone data generated by the half-tone process is rasterized by a print data generator 100 (FIG. 1) to generate print data PD for draft printing. Here, "rasterize" refers to a process for converting half-tone data to print data PD so that printing can be performed by the print head while scanning in the main scan direction and sub-scan direction. The rasterized print data PD includes raster data indicating dot recording status for each main scan, and data indicating the sub-scan feed amount.

Figure 13:
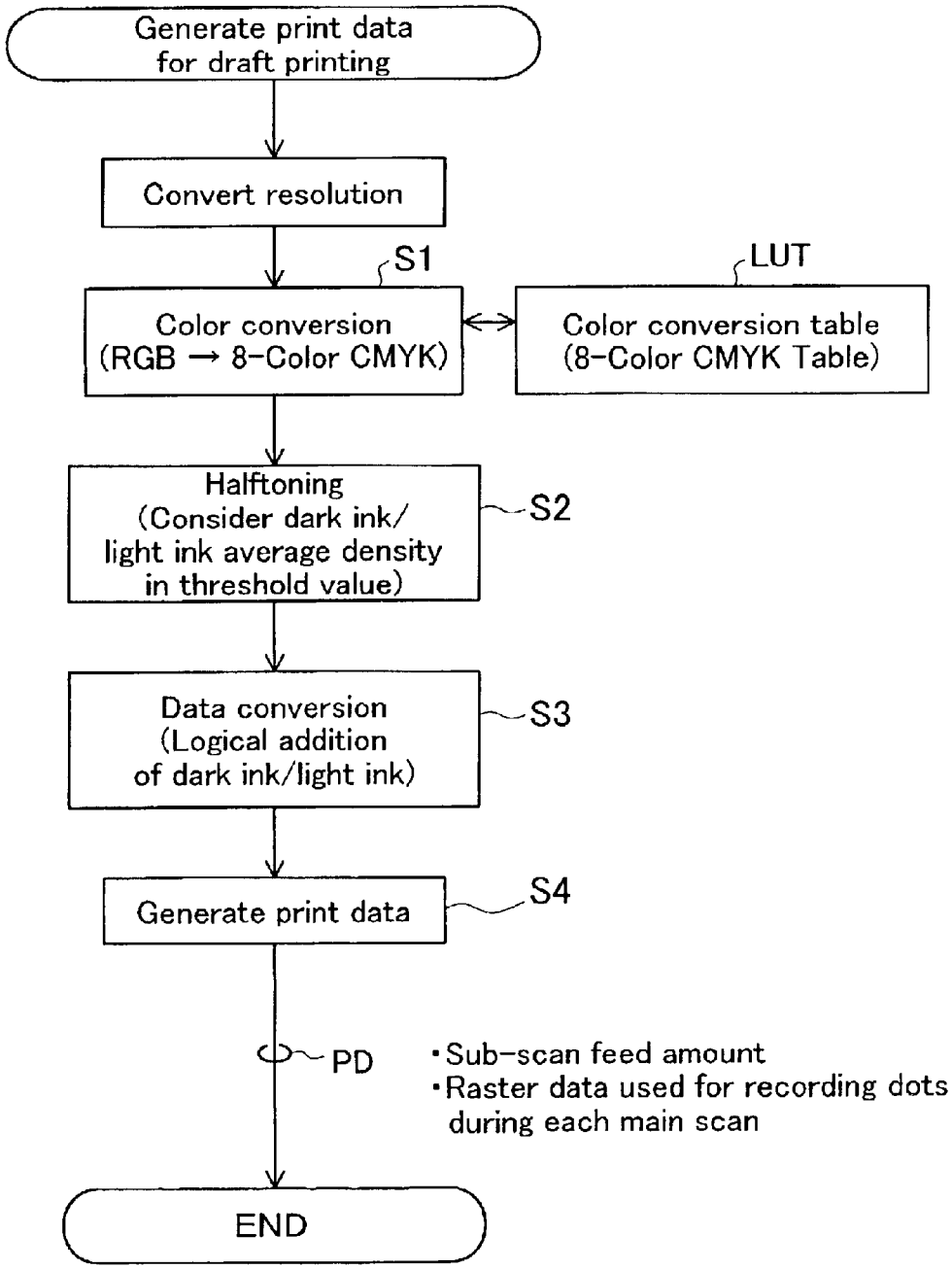
FIG. 13 is a flow chart depicting another process for generating print data PD.

FIG. 13 is a flow chart depicting another process for generating print data PD. This process generates print data PD for draft printing by converting half-tone data generated through color conversion on the assumption of eight colors of ink as in normal printing, and the half-tone process. Specifically, in Step S1 the printer driver 96 (FIG. 1) performs color conversion on the assumption of the eight colors of ink used in normal printing, making reference to a color conversion table LUT for normal printing. In Step S2 the multi-level data resulting from this half-tone process takes into consideration the average density of inks of different densities, in a manner analogous to direct generation of draft printing half-tone data from RGB graphics data. In Step S3 the half-tone data generated by the half-tone process is subjected to data conversion. Data conversion is accomplished through a process involving logical addition of dark ink half-tone data and light ink half-tone data for each main scan line. In Step S4 the converted half-tone data is rasterized to generate draft printing print data PD.

FIG. 14 is a process for conversion from print data PD for normal printing to print data PD for draft printing. Reference shall be made to this chart in the following description of a method for converting print data PD to generate normal printing to print data PD for draft printing. In the first comparative example (normal printing), the raster designated as Raster No. 1 would be produced during Pass 1 and Pass 2, but in the first embodiment is produced during Pass 1 only. Thus, in the first comparative example, raster data for nozzle #11 in Pass 1 and raster data for nozzle #00 in Pass 2 are used to produce the raster designated as Raster No. 1. These two nozzles are duplicate-scanned over a given pixel position and used in either selective or overstrike. In the first embodiment, on the other hand, printing is performed using only raster data for nozzle #00 during Pass 1. Accordingly, to generate raster data used in the first embodiment from raster data of first comparative example, it is necessary to generate raster data for printing any pixels that are pixels printed by nozzle #11 during Pass 1 and pixels printed by nozzle #00 during Pass 2 in the Comparison. Thus, it will be understood that the raster data used in the first embodiment can be obtained by logical addition of raster data for the two working nozzles in the first comparative example.

Some or all of the above processes may be performed by the printer driver on computer 90, or by printer firmware in color printer 20. Performed with firmware, the processes are performed by control circuit 40 (FIG. 3). Data sent from computer 90 is processed by CPU 41 using firmware stored in P-ROM 43.

Figure 15:
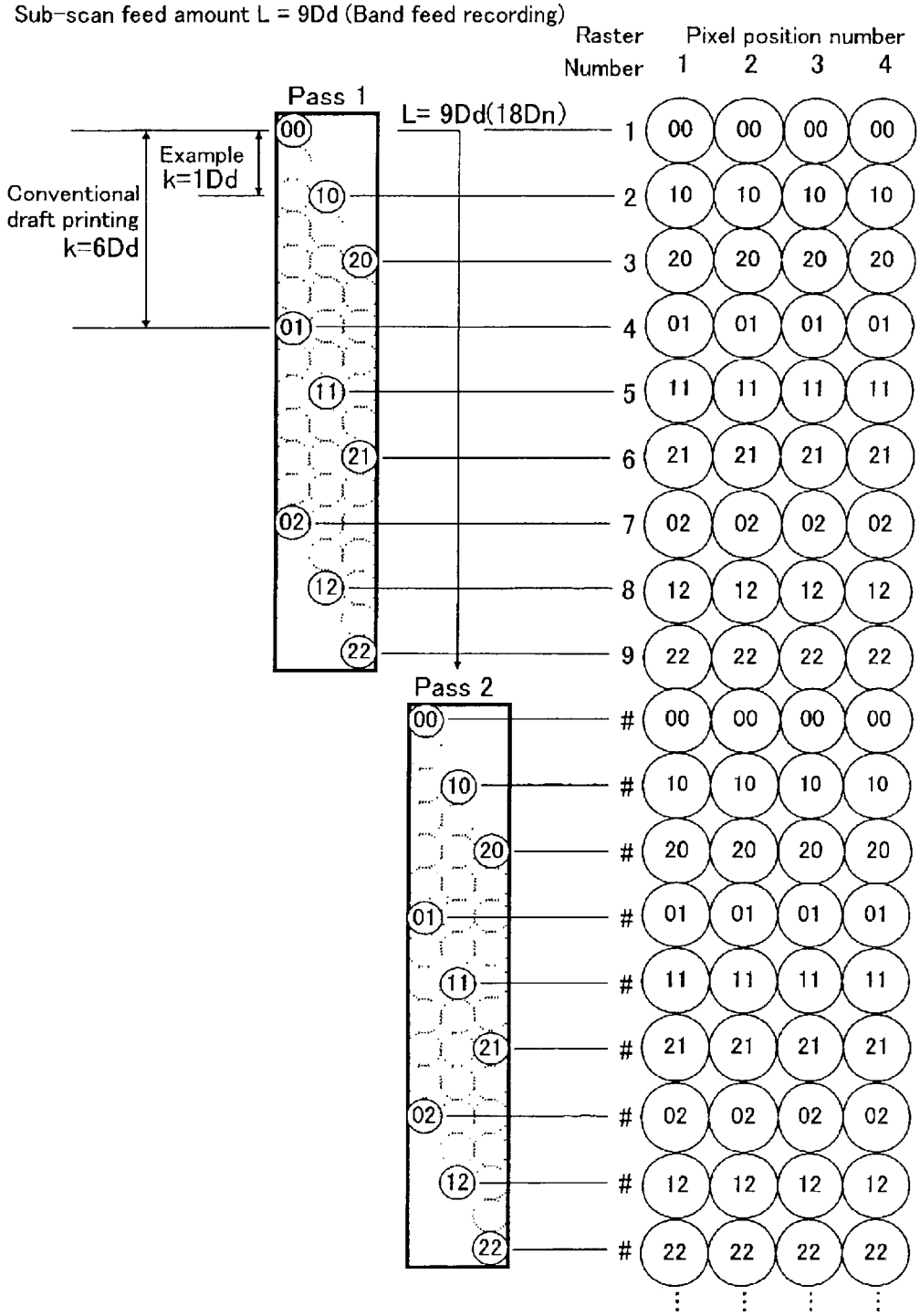
FIG. 15 is an illustrative diagram depicting the dot-printing format of the second embodiment of the invention.

FIG. 15 is an illustrative diagram depicting the dot-printing format of the second embodiment of the invention. The difference with the first embodiment depicted in FIG. 11 is that the number of nozzle groups is increased from two to three. In this embodiment, to produce more levels, the print head is envisioned as using three types of ink having different densities. That is, the head is provided with nozzle groups for three types of ink of the same hue and having different densities. As a specific example, nozzles #00, 01 and 02 are a nozzle group for ejecting high-density ink, nozzles #10, 11 and 12 for ejecting medium-density ink, and nozzles #20, 21 and 22 for ejecting low-density ink.

In the second embodiment, the effective number of nozzles Neff is increased to 9 from the 3 used in conventional draft printing, and nozzle pitch k is 1 Dd. Accordingly, rasters formed in a single pass are contiguous with no gaps. As a result, there is no need for sub-scan advance in interlaced format, enabling band advance analogous to the first embodiment, and thus greatly improving printing speed. Further, there is no limitation as the number of nozzle group rows, with implementation being analogous in the case of 4 rows or more.

Figure 16:
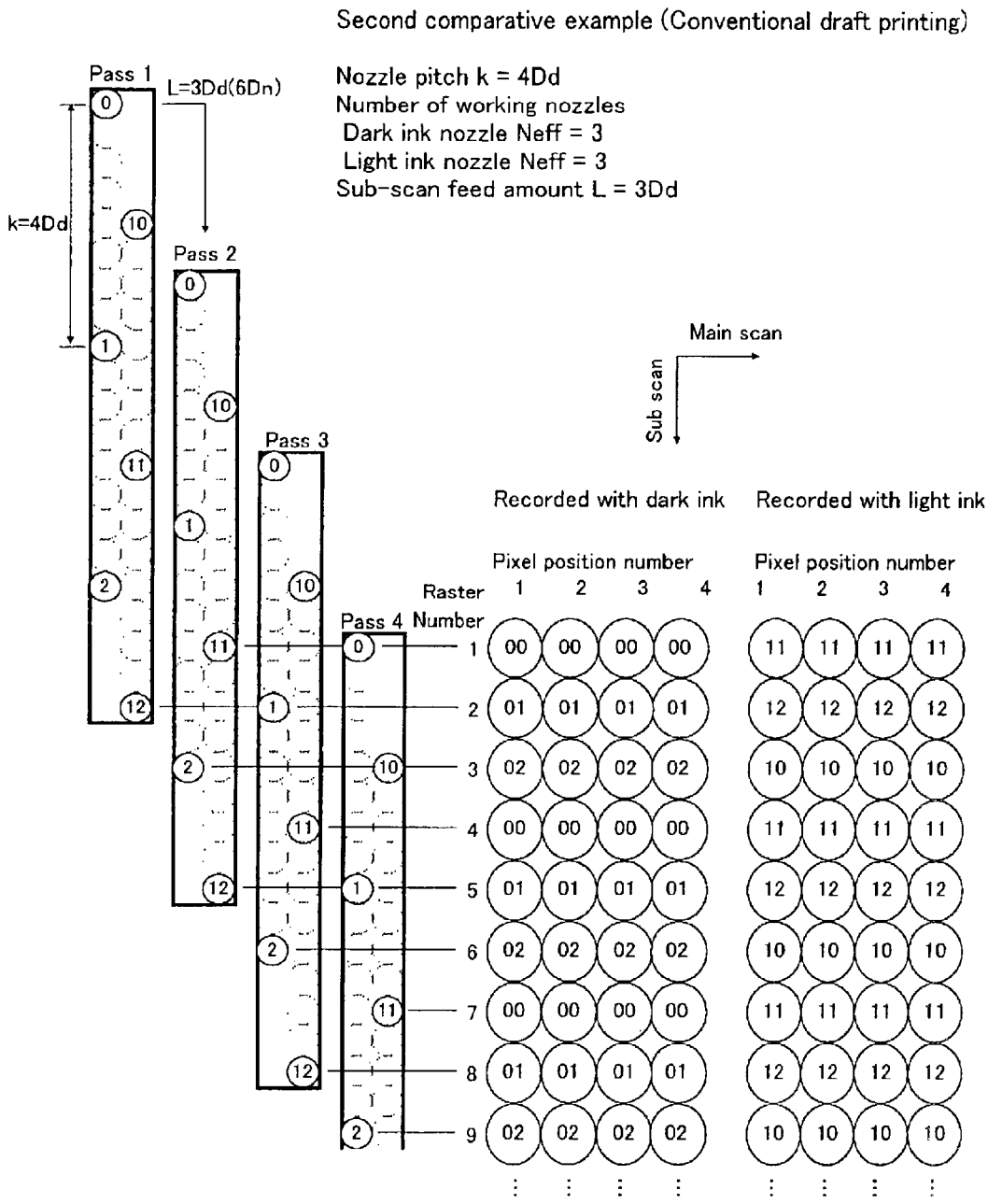
FIG. 16 is an illustrative diagram depicting second comparative example, which represents conventional draft printing.

FIG. 16 is an illustrative diagram depicting second comparative example, which represents conventional draft printing. The difference with the first comparative example shown in FIG. 10 is that the nozzle pitch k is increased from 2 Dd to 4 Dd. Parameters for this print format are Neff=3, k=4 Dd (=8 Dn), L=3 Dd (=6 Dn) and s=1. These parameters meet conditions c1' c–3' mentioned earlier. Accordingly, nozzle groups can perform printing without missing dots or unwanted overstrike of printed dots.

Figure 17:
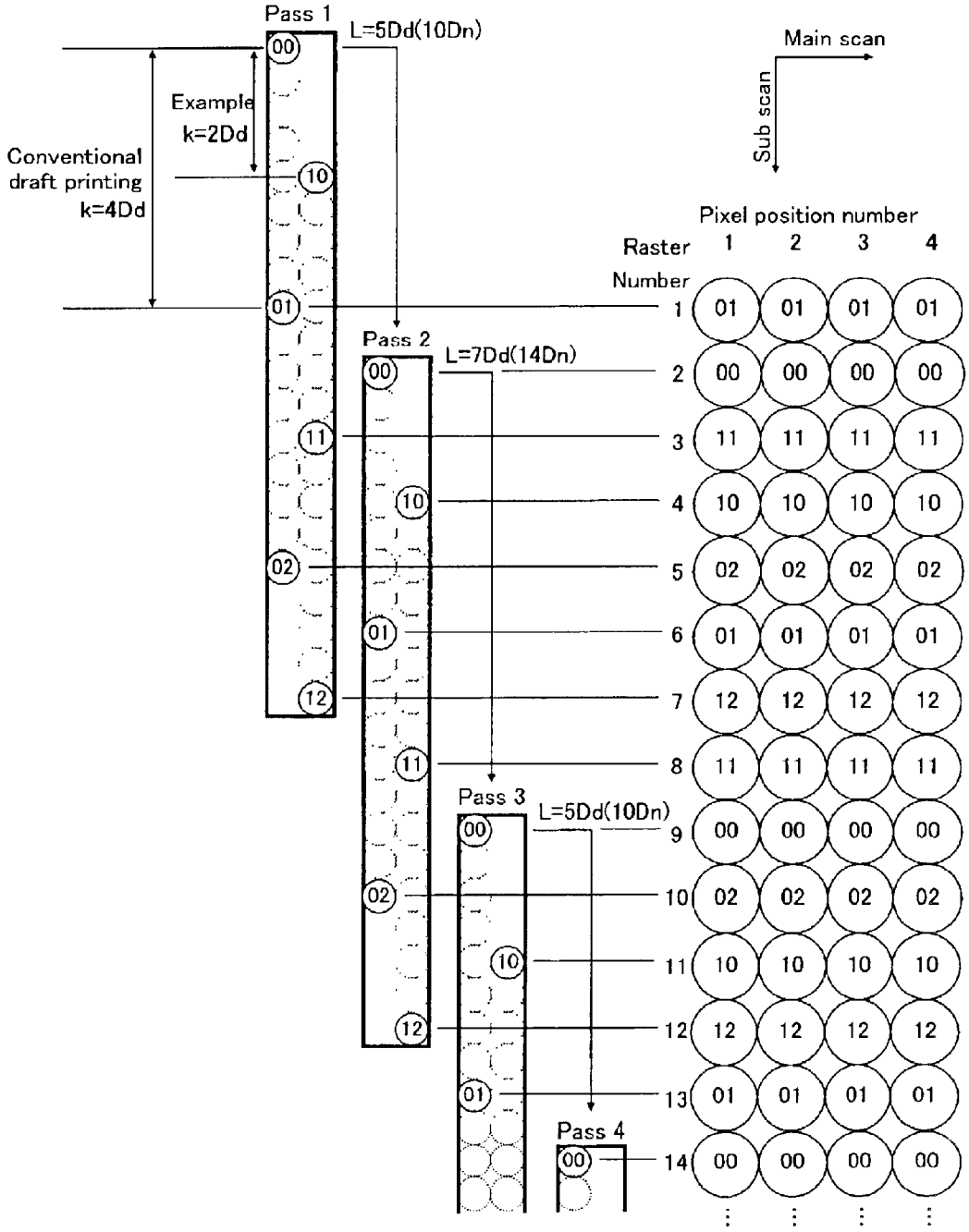
FIG. 17 is an illustrative diagram depicting the dot-printing format of the third embodiment of the invention.

FIG. 17 is an illustrative diagram depicting the dot-printing format of the third embodiment of the invention. The difference with the second comparative example shown in FIG. 16 is analogous to the difference between the first comparative example and the first embodiment, namely in that the dark ink nozzle group and light ink nozzle group produce dots on mutually different main scan lines. In the third embodiment, the effective number of nozzle Neff increases from 3 to 6, but nozzle pitch k is not 1 Dd, in contrast to the first embodiment shown in FIG. 11. Parameters for this print format are Neff=6, k=2 Dd (=4 Dn), L={5 Dd–7 Dd} ($\Sigma L/k$=6 Dd) and s=1. Here, the average sub-scan feed amount ($\Sigma L/k$) is equivalent to the product of the effective number of nozzle Neff and dot pitch Dd in draft printing, fulfilling condition c3'. In the third embodiment, the sub-scan feed amount is twice that in the second comparative example.

As noted, in the third embodiment, nozzle pitch k is not 1 Dd, so band advance is not possible. Thus, the interlaced format is used. Sub-scan advance in this embodiment takes place by repeated irregular advance by advance distances {5 Dd, 7 Dd} as shown in FIG. 17. The reason for not employing regular advance (sub-scan advance by a constant advance distance) is that if regular advance is employed, the sub-scan feed amount L (6 Dd) will be an integral multiple of nozzle pitch (2 Dd), so that nozzle offset after sub-scan advance is always zero. This is because where nozzle offset F after each sub-scan advance in one cycle is a value within the range 0-(k−1), and each value is repeated s times, condition c2' will not be met. Where, on the other hand, sub-scan advance is 5 Dd–7 Dd irregular advance, nozzle offset F after each sub-scan advance in one cycle repeatedly switches between "0" and "1". Accordingly, this print format meets condition c2', and by having a cycle composed of two sub-scan advances, at the same time meets condition c1'. By adopting these sub-scan advances, all of conditions c1'–c3' are met, and printing can be performed without missing dots or unwanted overstrike of printed dots.

Figure 18:
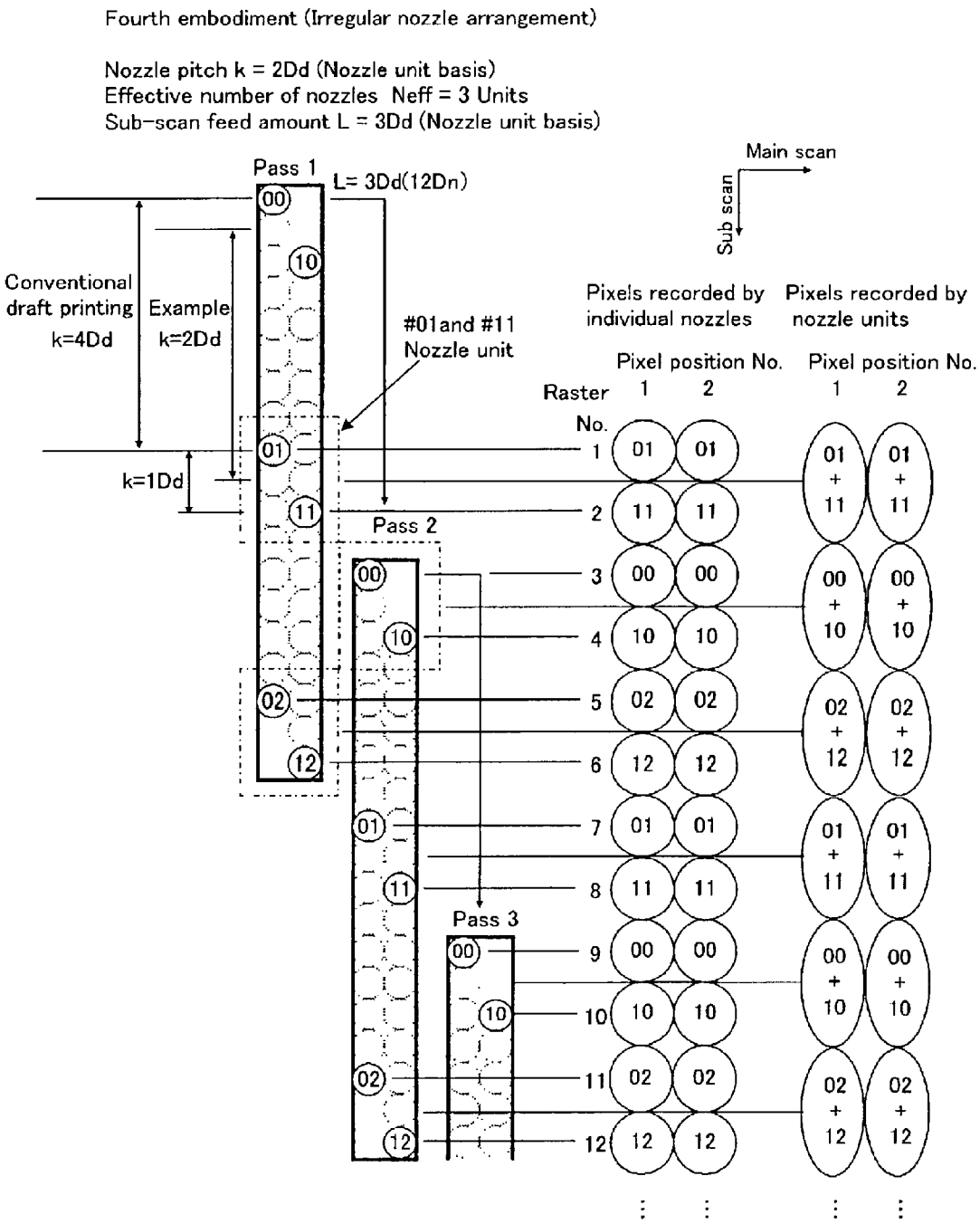
FIG. 18 is an illustrative diagram depicting the dot-printing format of the fourth embodiment of the invention.

FIG. 18 is an illustrative diagram depicting the dot-printing format of the fourth embodiment of the invention. The difference with the third embodiment depicted in FIG. 17 lies in the positional relationships of the nozzle groups. That is, whereas in the third embodiment, the extent of offset in the sub-scan direction of the nozzle group for ejecting dark ink and the nozzle group for ejecting light ink is half the nozzle pitch of the nozzle group, in the fourth embodiment the position is offset with respect to half The amount of offset is 1 Dd, so that rasters produced by nozzle groups are contiguous with no gaps.

In the fourth embodiment, nozzle groups are arranged offset so that rasters produced by the nozzle groups are contiguous with no spaces, and it is therefore possible to view two adjacent dark/light nozzles as together constituting a single nozzle. Specifically, as illustrated in FIG. 18, nozzles #00 and 10, #01 and 11, and #02 and 12 are each offset by 1 Dd in the sub-scan direction, produced rasters are contiguous with no gaps, allowing them to be considered as single nozzle units. Pixels to be printed by the nozzle units may be considered on the basis of pixels to be printed in normal printing mode, in which case there will be four in the sub-scan direction and two in the main scan direction. As a result, parameters for this print format are Neff=3 units, k=2 Dd, L=3 Dd (=12 Dn), and s=1. These parameters meet conditions c1' c–3' mentioned earlier. Accordingly, printing can be performed without missing dots or unwanted overstrike of printed dots.

Figure 19:
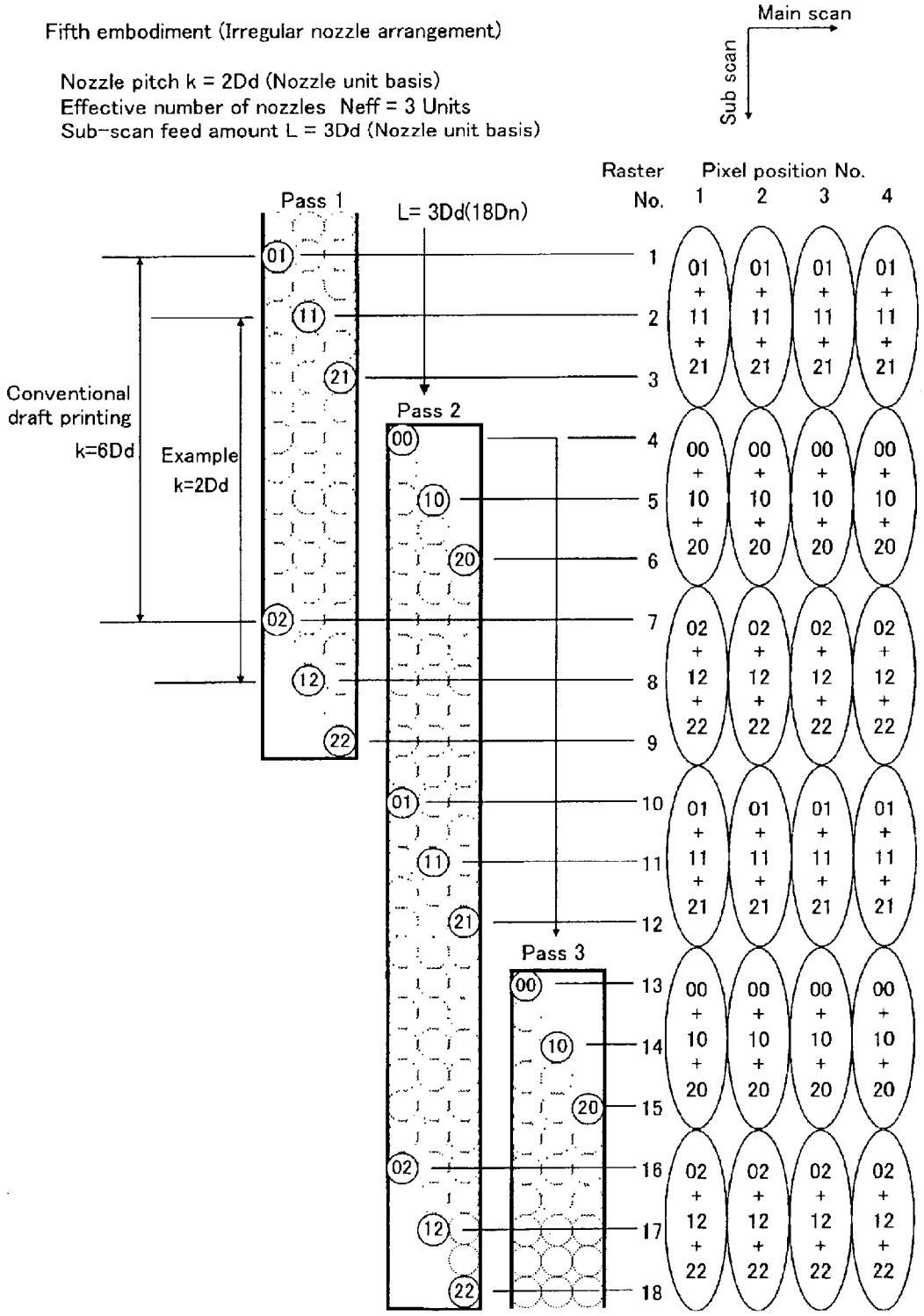
FIG. 19 is an illustrative diagram depicting the dot-printing format of the fifth embodiment of the invention.

FIG. 19 is an illustrative diagram depicting the dot-printing format of the fifth embodiment of the invention. The difference with the fourth embodiment in FIG. 18 is that the number of nozzle groups is increased from two to three. The difference with the second embodiment in FIG. 15 is that while the second embodiment features band advance, the fifth embodiment employs interlaced print format. In this embodiment, like in the fourth embodiment, nozzles #00, 10 and 20, #01, 11 and 21, and #02, 12 and 22 are each offset by 1 Dd in the sub-scan direction, produced rasters are contiguous with no gaps, allowing them to be considered as single nozzle units. Print format parameters are also the same as in the fourth embodiment, so that printing can be performed without missing dots or unwanted overstrike of printed dots. By arranging nozzle groups so as to be offset by 1 Dd in the sub-scan direction to construct nozzle groups capable of producing contiguous rasters with no gaps, conditions c1' c–3' can be met on the basis of the nozzle units, allowing implementation with four or more nozzle groups as well.

Figure 20:
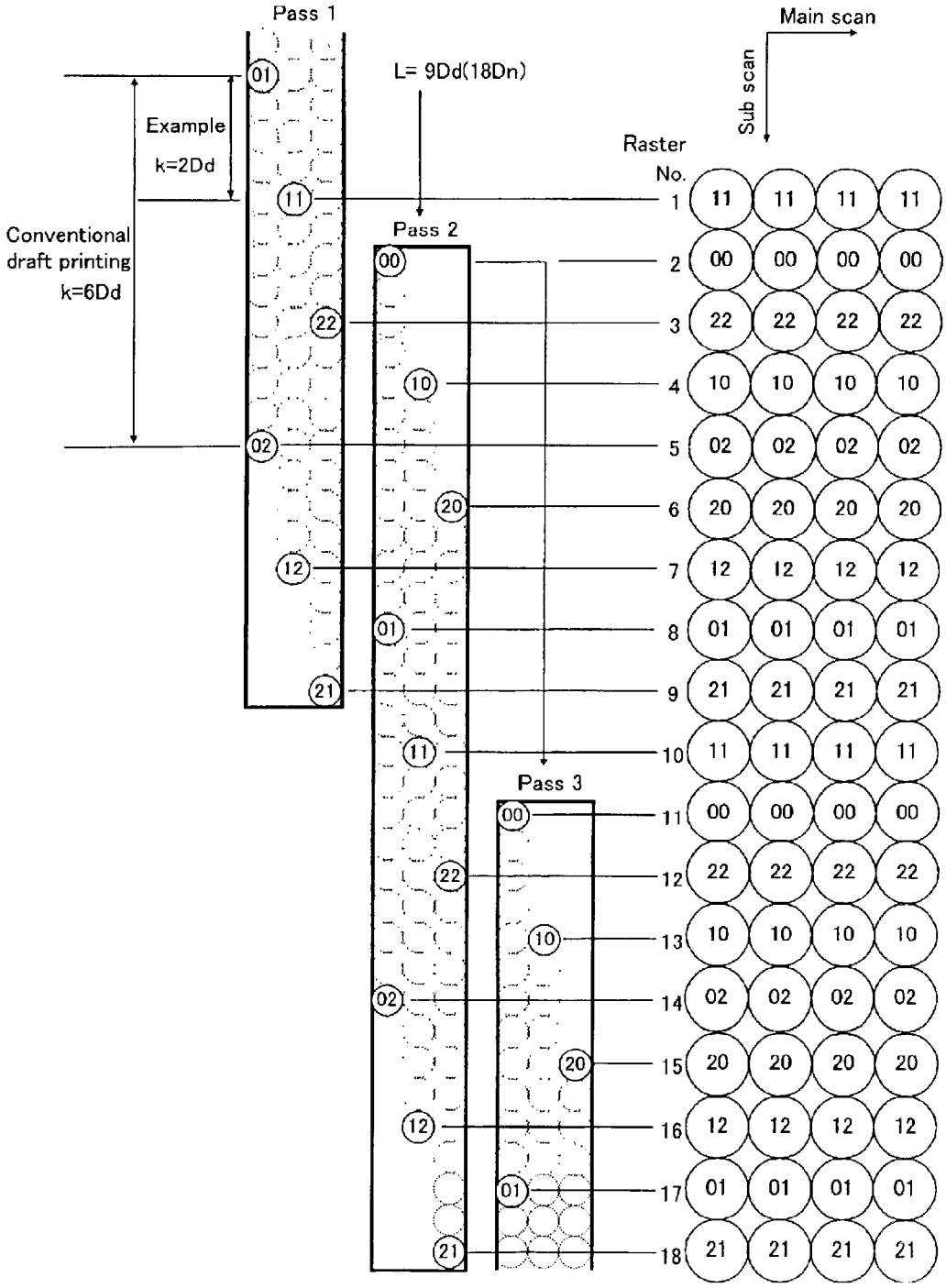
FIG. 20 is an illustrative diagram depicting the dot-printing format of the sixth embodiment of the invention.

FIG. 20 is an illustrative diagram depicting the dot-printing format of the sixth embodiment of the invention. The difference with the third embodiment in FIG. 17 is that nozzle groups are increased from two rows to three rows. Parameters for this print format are Neff=9, k=2 Dd, L=9 Dd (=18 Dn), and s=1. These parameters meet conditions c1' c–3' mentioned earlier. That is, similar to the case with two rows, in the case of three rows also, printing can be performed without missing dots or unwanted overstrike of dots printed at a constant advance distance. Further, there is no limitation as the number of nozzle group rows, with implementation being analogous in the case of 4 rows or more, provided that conditions c1' c–3' are met.

The preceding examples and embodiments are merely intended to facilitate understanding of the invention and not limiting thereof, and various modifications and improvements thereto will be apparent to the skilled practitioner without departing from the scope and spirit thereof, such as the following.

In the preceding embodiment, same-hue inks having the same hue and different in lightness and saturation were used. However, it would also be acceptable to use a plurality of same-hue inks having the substantially same hue and different in at least one of lightness and saturation. The plurality of same-hue inks are defined as a combination of inks comprising:

(1) first ink which is one of four basic inks including a cyan ink, a magenta ink, a yellow ink, and a non-gray black ink capable of reproducing a black color by being mixed; and (2) second ink which has closer hue to the first ink than any other of the four basic inks.

The invention is not limited to color printing, and may be applied to monochromatic printing as well. In a drum printer, the direction of drum rotation corresponds to the main scan direction, and the carriage travel direction to the sub-scan direction. The invention is not limited to application in ink-jet printers, and may be implemented generally in any sort of dot-printing device involving recording on the surface of a print medium using a print head having an array of dot-forming elements for forming a plurality of dots. Here, "dot-forming elements" refers to elements for forming dots, such as the ink nozzles of an ink-jet printer.

Some of the elements realized through hardware in the preceding embodiments may be replaced by software, and conversely some of the elements realized through software in the preceding embodiments may be replaced by hardware. For example, some of all of the functions performed by the printer driver 96 shown in FIG. 1 may instead by executed by the control circuit 40 of the printer 20. In this case, some of all of the functions performed by the computer 90 as the printing control apparatus for generating print data may instead be realized by the control circuit 40 of the printer 20.

Where some of all of the functions herein are realized through software, the software (i.e. computer programs) may be provided in a form stored on a computer-readable storage medium. As used herein the term "computer-readable storage medium" is not limited to portable media such as flexible disk or CD-ROM, but also includes computer internal storage devices such as the various flavors of RAM and ROM, and external storage devices fixed to the computer, such as a hard disk.

The preceding description of the examples of the invention herein has been made with reference to a print format using a total of 8 or 12 types of ink having four different hues. However the invention is not limited to this arrangement, it being possible within the scope of the invention to employ any printing format using a total of M (where M is positive integer equal to or greater than N+1) types of ink, these inks having N (where N is a positive integer) different hues.

What is claimed is:

1. A method of printing by forming ink dots on a print medium during main scans, comprising the steps of:

(a) providing a print head comprising a same hue nozzle group for ejecting a plurality of same-hue inks having the substantially same hue and different in at least one of lightness and saturation, the same hue nozzle group including a plurality of same-ink nozzle sub groups arranged at mutually staggered positions in sub scan direction, each of the plurality of same ink nozzle sub-groups ejecting a same ink; and (b) forming ink dots with the plurality of same ink nozzle sub-groups during each main scan in a predetermined fast printing mode, such that each of the plurality of same ink nozzle sub groups ejects the same ink on mutually different main scan lines, due to the mutually staggered positions of the plurality of same-ink nozzle sub-groups.

2. The method in accordance with claim 1, wherein the print head is capable of ejecting M types of inks, the M types of inks having N different hues, N being an integer of at least 1, M being an integer of at least N+1;

the method further comprising the steps of:

(c) converting a color system of image data indicative of a image to be printed to generate converted image data represented with a plurality of color components; and (d) generating dot data from the converted image data, the dot data representing a state of dot formation at each pixel for the plurality of color components;

wherein the step (c) is executed in the fast print mode such that the converted image data is represented with N color components of the N hues, without distinguishing the plurality of same-hue inks.

3. The method in accordance with claim 1, wherein the print head is capable of ejecting M types of inks, the M types of inks having N different hues, N being an integer of at least 1, M being an integer of at least N+1;

the method further comprising the steps of:

(c) converting a color system of image data indicative of a image to be printed to generate converted image data represented with M types of color components corresponding to the M types of ink;

(d) generating dot data from the converted image data, the dot data representing a state of dot formation at each pixel for the M types of color components; and (e) converting the dot data to converted dot data by performing logical addition of the dot data corresponding to the plurality of same-hue inks at each pixel, the converted dot data representing a state of dot formation at each pixel for the N color components of the N hues in the fast print mode.

4. The method in accordance with claim 1, wherein the print head is capable of ejecting M types of inks, the M types of inks having N different hues, N being an integer of at least 1, M being an integer of at least N+1;

the method further comprising the steps of:

(c) converting a color system of image data indicative of a image to be printed to generate converted image data represented with M types of color components corresponding to the M types of ink; and (d) generating dot data from the converted image data, the dot data representing a state of dot formation at each pixel for the M types of color components;

(e) generating print data from the dot data, the print data including raster line data representing a status of ink ejection from each nozzle during each main scan; and (f) converting the raster line data to converted raster line data by performing logical addition of the raster line data corresponding to the plurality of same hue inks at each pixel, the converted raster line data representing a status of ink ejection from each nozzle during each main scan for the N color components of the N hues in the fast print mode.

5. The method in accordance with claim 1, wherein the plurality of same-ink nozzle sub groups included in the same-hue nozzle group are arrayed in a single row in the sub scan direction.

6. The method in accordance with claim 1, wherein the print data includes sub-scan feed amount for relatively moving a selected one of the print head and the print medium in the sub-scan direction; and wherein the sub-scan feed amount is set to a sub-scan direction length of an area composed of array of dots produced with the same-hue nozzle group during a single main scan pass in the fast printing mode.

7. A printing apparatus for forming ink dots on a print medium during main scan, comprising:

a print head having a same-hue nozzle group for ejecting a plurality of same-hue inks having the substantially same hue and different in at least one of lightness and saturation, the same-hue nozzle group including a plurality of same-ink nozzle sub groups arranged at mutually staggered positions in sub-scan direction, each of the plurality of same ink nozzle sub-groups ejecting a same ink; and a print data generator configured to generate a print data configured to form ink dots with the plurality of same-ink nozzle subgroups during each main scan in a predetermined fast printing mode such that each of the plurality of same-ink nozzle subgroups ejects the same ink on mutually different main scan lines, due to the mutually staggered positions of the plurality of same-ink nozzle sub-groups; and a printing unit configured to form ink dots with the print head on the print medium in response to the generated print data.

8. The printing apparatus in accordance with claim 7, wherein the print head is capable of ejecting M types of inks, the M types of inks having N different hues, N being an integer of at least 1, M being an integer of at least N+1;

the printing apparatus further comprising a color converter configured to convert a color system of image data indicative of a image to be printed to generate converted image data represented with a plurality of color components; and a dot data generator configured to generate dot data from the converted image data, the dot data representing a state of dot formation at each pixel for the plurality of color components;

wherein the color converter is configured to execute in the fast print mode such that the converted image data is represented with N color components of the N hues, without distinguishing the plurality of same-hue inks.

9. The printing apparatus in accordance with claim 7, wherein the print head is capable of ejecting M types of inks, the M types of inks having N different hues, N being an integer of at least 1, M being an integer of at least N+1;

the printing apparatus further comprising a color converter configured to convert a color system of image data indicative of a image to be printed to generate converted image data represented with M types of color components corresponding to the M types of ink;

a dot data generator configured to generate dot data from the convened image data, the dot data representing a state of dot formation at each pixel for the M types of color components; and a dot data converter configured to convert the dot data to converted dot data by performing logical addition of the dot data corresponding to the plurality of same-hue inks at each pixel, the converted dot data representing a state of dot formation at each pixel for the N color components of the N hues in the fast print mode.

10. The printing apparatus in accordance with claim 7, wherein the print head is capable of ejecting M types of inks, the M types of inks having N different hues, N being an integer of at least 1, M being an integer of at least N+1;

the printing apparatus further comprising a color converter configured to convert a color system of image data indicative of a image to be printed to generate converted image data represented with M types of color components corresponding to the M types of ink; and a dot data generator configured to generate dot data from the converted image data, the dot data representing a state of dot formation at each pixel for the M types of color components;

a print data generator configured to generate print data from the dot data, the print data including raster line data representing a status of ink ejection from each nozzle during each main scan; and a raster line dot data converter configured to convert the raster line data to converted raster line data by performing logical addition of the raster line data corresponding to the plurality of same-hue inks at each pixel, the converted raster line data representing a status of ink ejection from each nozzle during each main scan for the N color components of the N hues in the fast print mode.

11. The printing apparatus in accordance with claim 7, wherein the plurality of same-ink nozzle subgroups included in the same-hue nozzle group are arrayed in a single row in the sub-scan direction.

12. The printing apparatus in accordance with claim 7, wherein the print data includes sub-scan feed amount for relatively moving a selected one of the print head and the print medium in the sub scan direction; and wherein the sub scan feed amount is set to a sub-scan direction length of an area composed of array of dots produced with the same-hue nozzle group during a single main scan pass in the fast printing mode.

13. A printing control apparatus for generating print data to be supplied to a printing unit having a print head to form ink dots on a print medium during main scans, wherein the print head comprises a same-hue nozzle group for ejecting a plurality of same-hue inks having the substantially same hue and different in at least one of lightness and saturation, the same hue nozzle group including a plurality of same-ink nozzle sub-groups arranged at mutually staggered positions in sub-scan direction, each of the plurality of same-ink nozzle sub-groups ejecting a same ink; and the printing control apparatus generate a print data configured for the printing unit to form ink dots with the plurality of same-ink nozzle sub-groups during each main scan in a predetermined fast printing mode, such that each of the plurality of same ink nozzle sub-groups ejects the same ink on mutually different main scan lines, due to the mutually staggered positions of the plurality of same ink nozzle subgroups.

14. The printing control apparatus in accordance with claim 13, wherein the print head is capable of ejecting M types of inks, the M types of inks having N different hues, N being an integer of at least 1, M being an integer of at least N+1;

the printing control apparatus further comprising:

a color converter configured to convert a color system of image data indicative of a image to be printed to generate converted image data represented with a plurality of color components; and a dot data generator configured to generate dot data from the converted image data, the dot data representing a state of dot formation at each pixel for the plurality of color components;

wherein the color converter is configured to execute in the fast print mode such that the converted image data is represented with N color components of the N hues, without distinguishing the plurality of same hue inks.

15. The printing control apparatus in accordance with claim 13, wherein the print head is capable of ejecting M types of inks, the M types of inks having N different hues, N being an integer of at least 1, M being an integer of at least N+1;

the printing control apparatus further comprising:

a color converter configured to convert a color system of image data indicative of a image to be printed to generate converted image data represented with M types of color components corresponding to the M types of ink;

a dot data generator configured to generate dot data from the converted image data, the dot data representing a state of dot formation at each pixel for the M types of color components; and a dot data converter configured to convert the dot data to converted dot data by performing logical addition of the dot data corresponding to the plurality of same-hue inks at each pixel, the converted dot data representing a state of dot formation at each pixel for the N color components of the N hues in the fast print mode.

16. The printing control apparatus in accordance with claim 13, wherein the print head is capable of ejecting M types of inks, the M types of inks having N different hues, N being an integer of at least 1, M being an integer of at least N+1;

the printing control apparatus further comprising:

a color converter configured to convert a color system of image data indicative of a image to be printed to generate converted image data represented with M types of color components corresponding to the M types of ink;

a dot data generator configured to generate dot data from the converted image data, the dot data representing a state of dot formation at each pixel for the M types of color components;

a print data generator configured to generate the print data from the dot data, the print data including raster line data representing a status of ink ejection from each nozzle during each main scan; and a raster line dot data converter configured to convert the raster line data to converted raster line data by performing logical addition of the raster line data corresponding to the plurality of same-hue inks at each pixel, the converted raster line data representing a status of ink ejection from each nozzle during each main scan for the N color components of the N hues in the fast print mode.

17. The printing control apparatus in accordance with claim 13, wherein the plurality of same ink nozzle subgroups included in the same hue nozzle group are arrayed in a single row in the sub scan direction.

18. The printing control apparatus in accordance with claim 13, wherein the print data includes sub-scan feed amount for relatively moving a selected one of the print head and the print medium in the sub scan direction; and wherein the sub-scan feed amount is set to a sub-scan direction length of an area composed of array of dots produced with the same-hue nozzle group during a single main scan pass in the fast printing mode.

19. A computer program product for causing a computer to generate print data to be supplied to a printing unit to form ink dots on a print medium during main scan, wherein the printing unit comprises a print head having a same-hue nozzle group for ejecting a plurality of same-hue inks having the substantially same hue and different in at least one of lightness and saturation, the same-hue nozzle group including a plurality of same ink nozzle sub-groups arranged at mutually staggered positions in sub-scan direction, each of the plurality of same-ink nozzle sub-groups ejecting a same ink; and the computer program product comprising:

a computer readable medium; and a computer program stored on the computer readable medium, the computer program comprising a first program for causing the computer to generate a print data configured to form ink dots with the plurality of same-ink nozzle sub groups during each main scan in a predetermined fast printing mode, such that each of the plurality of same-ink nozzle sub-groups ejects the same ink on mutually different main scan lines, due to the mutually staggered positions of the plurality of same-ink nozzle subgroups.

20. The computer program product in accordance with 19, wherein the print head is capable of ejecting M types of inks, the M types of inks having N different hues, N being an integer of at least 1, M being an integer of at least N+1;

the computer program further comprising:

a second program for causing the computer to convert a color system of image data indicative of a image to be printed to generate converted image data represented with a plurality of color components; and a third program for causing the computer to generate dot data from the converted image data, the dot data representing a state of dot formation at each pixel for the plurality of color components;

wherein the second program is configured to execute in the fast print mode such that the converted image data is represented with N color components of the N hues, without distinguishing the plurality of same hue inks.

21. The computer program product in accordance with 19, wherein the print head is capable of ejecting M types of inks, the M types of inks having N different hues, N being an integer of at least 1, M being an integer of at least N+1;

the computer program further comprising:

a second program for causing the computer to convert a color system of image data indicative of a image to be printed to generate converted image data represented with M types of color components corresponding to the M types of ink;

a third program for causing the computer to generate dot data from the converted image data, the dot data representing a state of dot formation at each pixel for the M types of color components; and a fourth program for causing the computer to convert the dot data to converted dot data by performing logical addition of the dot data corresponding to the plurality of same hue inks at each pixel, the converted dot data representing a state of dot formation at each pixel for the N color components of the N hues in the fast print mode.

22. The computer program product in accordance with 19, wherein the print head is capable of ejecting M types of inks, the M types of inks having N different hues, N being an integer of at least 1, M being an integer of at least N+1;

the computer program further comprising:

a second program for causing the computer to convert a color system of image data indicative of a image to be printed to generate converted image data represented with M types of color components corresponding to the M types of ink;

a third program for causing the computer to generate dot data from the converted image data, the dot data representing a state of dot formation at each pixel for the M types of color components;

a fourth program for causing the computer to convert the print data from the dot data, the print data including raster line data representing a status of ink ejection from each nozzle during each main scan; and a fifth program for causing the computer to convert the raster line data to converted raster line data by performing logical addition of the raster line data corresponding to the plurality of same-hue inks at each pixel, the converted raster line data representing a status of ink ejection from each nozzle during each main scan for the N color components of the N hues in the fast print mode.

* * * * *